United States Patent [19]

Hart

[11] 4,208,966

[45] Jun. 24, 1980

[54] METHODS AND APPARATUS FOR SELECTIVELY OPERATING MULTI-CHARGE WELL BORE GUNS

[75] Inventor: Herbert J. Hart, Houston, Tex.

[73] Assignee: Schlumberger Technology Corporation, New York, N.Y.

[21] Appl. No.: 879,161

[22] Filed: Feb. 21, 1978

[51] Int. Cl.[2] ..... E21B 43/116; G01R 31/02

[52] U.S. Cl. ..... 102/20; 102/21.6; 175/4.55; 175/40; 340/858; 346/33 WL

[58] Field of Search ..... 102/20, 21.6; 340/15.5 R, 15.5 A, 15.5 AP, 15.5 AC, 18 R; 89/1 C; 175/4.51, 4.55, 40; 166/63, 250; 361/248, 250; 346/33 WL; 73/152

[56] References Cited

U.S. PATENT DOCUMENTS

| | | | |
|---|---|---|---|
| 2,349,041 | 5/1944 | Hare | 175/4.51 |
| 2,677,790 | 5/1954 | Arps | 102/21.6 |
| 2,755,432 | 7/1956 | Arps et al. | 346/33 WL |
| 3,028,528 | 4/1962 | Ghiselin, Jr. | 361/248 |
| 3,202,227 | 8/1965 | Ezran | 89/1 C |
| 3,495,212 | 2/1970 | Brock | 340/18 R |
| 3,860,865 | 1/1975 | Stroud | 89/1 C |
| 4,051,907 | 10/1977 | Estes | 102/21.6 |

*Primary Examiner*—David H. Brown

[57] ABSTRACT

In the representative embodiments of the new and improved methods and apparatus disclosed herein for controlling multicharge perforating guns or core-sampling guns, the gun-control system of the present invention includes a selectively-operable multi-contact switch assembly operative from the surface to sequentially connect a group of electrically-detonatable charges into a firing circuit for consecutively firing the charges on the gun. An array of serially-connected Zener diodes cooperatively associated with the switch assembly provides indications at the surface showing which of the several charges is then connected into the gun-firing circuit. The new and improved gun-control system also includes a shot-monitoring system which provides additional surface indications from which it can be determined whether the charges on the gun are being successfully fired and, at least approximately, that they are being consecutively fired.

81 Claims, 7 Drawing Figures

FIG. 5
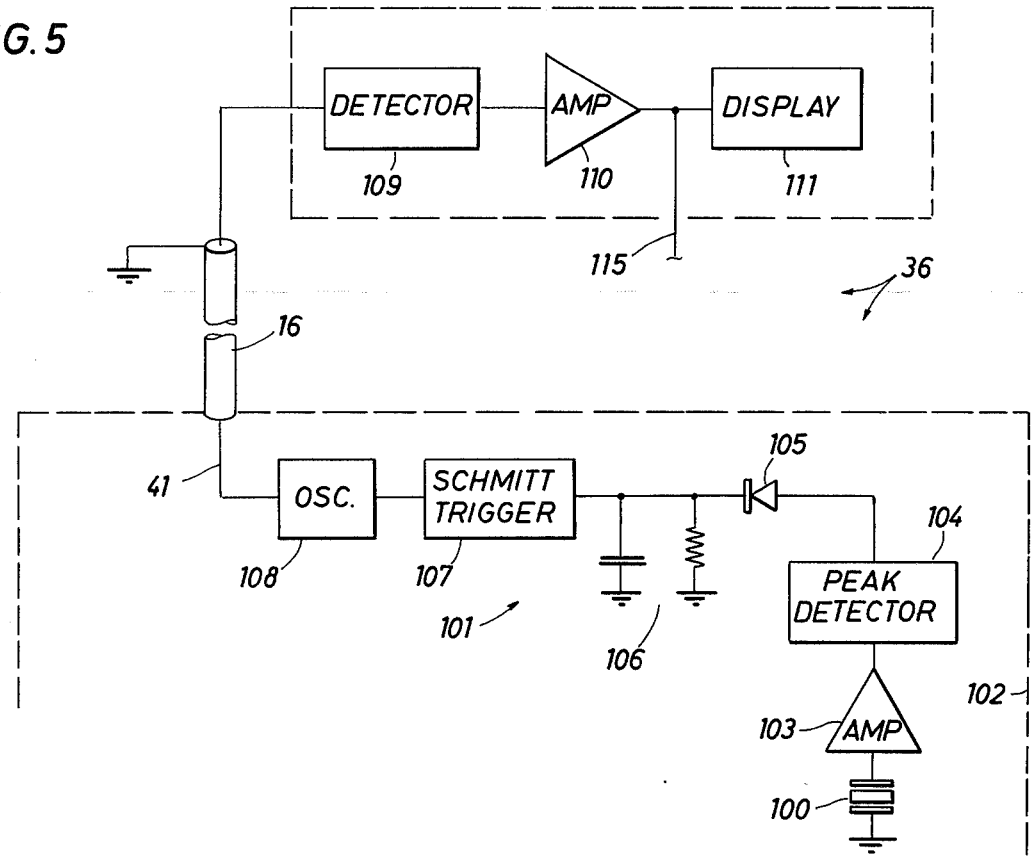
FIG. 6
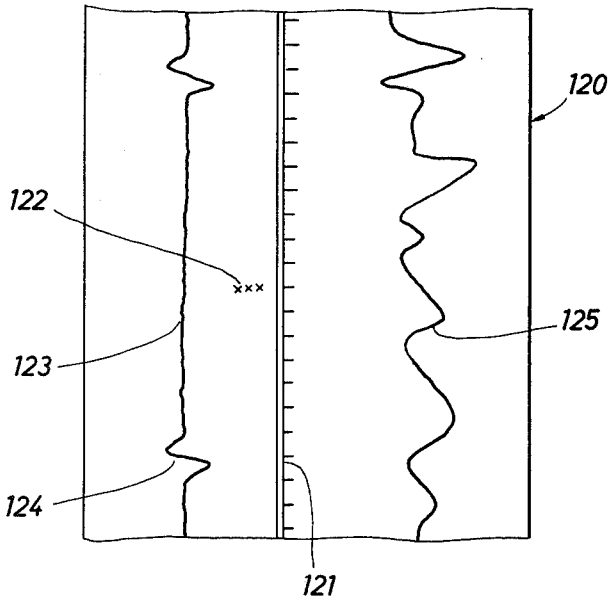
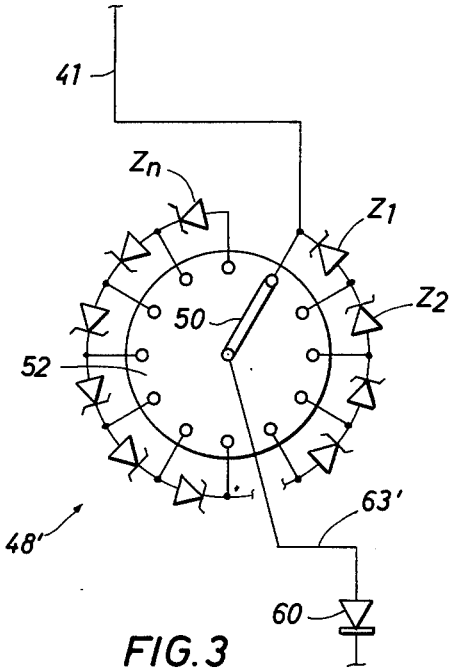
FIG. 3

METHODS AND APPARATUS FOR SELECTIVELY OPERATING MULTI-CHARGE WELL BORE GUNS

In present-day well-completion operations it is, of course, quite common for various types of wireline tools to be equipped with two or more selectively-actuated explosive charges. As one example of such tools, samples of formation materials are often obtained by way of selectively-operated formation-coring guns such as disclosed in U.S. Pat. No. 3,202,227. As described there in more detail, open-ended tubular projectiles or coring bullets are arranged in lateral bores spatially disposed along an elongated tool body and cooperatively arranged to be forcibly propelled against an adjacent formation wall upon selective detonation of an encapsulated explosive charge disposed in the bore behind each of the bullets. Short retaining cables secure the bullets to the gun body so that when the gun is returned to the surface, the formation samples captured within the bullets will be recovered. As pointed out in that patent, the usual operating practice is to successively actuate the core-sampling tool at selected depth locations in a borehole for obtaining representative core samples from various formation intervals of possible interest which are intersected by the borehole.

As another common example of such successively-operated wireline tools, one or more shaped explosive charges are respectively mounted within hollow carriers and coupled to an electrically-responsive explosive detonator which, when actuated, will fire the shaped charges for perforating the adjacent casing and cement sheath usually lining the walls of a borehole. U.S. Pat. No. 3,327,791 and U.S. Pat. No. 3,329,218 respectively describe selectively-fired perforating guns having a single charge in each of several heavy-walled non-expendable carriers. Another typical perforating gun in widespread use today employs wholly-expedable thin-walled tubular carriers such as those shown in U.S. Pat. No. 3,429,384 which are alternatively arranged in a tandem assembly of either a few long carriers having many commonly-fired shaped charges or else a larger number of relatively-short carriers respectively carrying only one or two shaped charges. In either case, those selectively-fired guns are commonly controlled by firing circuits using diodes and Zener diodes as well as solenoid-actuated stepping switches such as described in the above-cited U.S. Pat. No. 3,327,791.

It is also recognized by those skilled in the art that various so-called "shot-position indicators" have been proposed or employed heretofore to give indications at the surface representing that a given explosive device on a gun is then connected into the firing circuit of the gun. Most, if not all, of such prior-art position-indicating system have utilized various measurement circuits arranged to provide distinctive surface indications as a downhole switching assembly is being operated to connect a particular explosive charge into the firing circuit. Typically these measurement circuits are arranged to vary the circuit either by alternately adding or removing distinctive resistive elements (e.g., as shown in U.S. Pat. No. 3,202,227) or by progressively adding or removing individual ones of a serial array of identical resistive elements (e.g., as shown in U.S. Pat. No. 2,338,872 or in U.S. Pat. No. 3,860,865). In both of those two circuit arrangements, the position-indicating signals are obtained by measuring at the surface the overall impedance changes across the cable conductors which occur as these resistive elements are switched into or out of a series electrical circuit. The measurements will, of necessity, be significantly influenced by the overall electrical resistance of the cable conductors. As a result, heretofore, it has ordinarily been difficult to provide fully-reliable surface indications of this nature which are not significantly affected by unpredictable or unavoidable variations in the electrical resistance of the cable and return path loops.

Those skilled in the art will also appreciate that the satisfactory operation of any of these multi-shot core-sampling guns or perforating guns is adversely affected should one or more of the explosive charges on that gun inadvertently fail or misfire and such mishaps go undetected until after the gun has been brought to the surface. Although the gun can usually be repaired and returned to repeat the operation as necessary, the additional time required to rectify the situation can represent a needless expense of some magnitude. Obviously delays of this nature can be avoided if such misfires can be immediately detected so that another charge can be fired before moving the gun to a different depth location in the well bore.

Various types of so-called "shot detectors" have, of course, been employed heretofore. For instance, as shown in U.S. Pat. No. 2,871,784, one prior system had a concussion-responsive inertial switch mounted in the head of a typical multi-shot gun and arranged for temporarily interrupting the firing circuit in response to the recoil movement of the gun. Other guns have been provided with downhole microphones to transmit the sound of the firing of the gun to the surface. In a somewhat similar manner, an acceleration-responsive crystal-controlled oscillator has also been arranged as described in Pat. No. 3,495,212 issued to George W. Brock and mounted in the head of a perforating or core-sampling gun for momentarily producing characteristic output signals following the detonation of each explosive charge in the gun which signals provide suitable surface indications and, after a given or fixed time interval, function to then interrupt the electrical firing circuit of the gun.

These prior-art "shot detectors" are, however, generally limited to provide an indication which, from a practical standpoint, shows only that an explosive force of some undetermined magnitude had been imposed upon the gun. Apparently no consideration has previously been given to arranging such prior-art devices for providing an output indication which is representative of the magnitude of a given explosive force imposed on a gun.

Accordingly, it is an object of the present invention to provide new and improved apparatus and techniques for reliably controlling and monitoring well tools having a plurality of explosively-actuated charges that are to be successively operated.

This and other objects of the present invention are attained by arranging new and improved apparatus including multi-position switching means on a gun adapted for suspension from a suspension cable and to carry a plurality of electrically-detonatable explosive charges which are to be respectively connected to electrical conductors in the cable upon sequential advancement of the switching means to successive operating positions. Voltage-responsive means operatively coupled to the switching means present unique responses to DC voltage at one or more selected operating positions of the switching means. AC and DC source means are connected to the cable conductors and, by way of appropriate electrical circuit means, are cooperatively arranged to provide offsetting signals or measurements respectively representative of the electrical resistance of the cable conductors so that the unique DC responses attributable to each selected operating position of the switching means can be readily identified. To monitor the firing of the several explosive charges, the new and improved apparatus of the present invention further includes impact-responsive transducer means mounted on the gun and, by way of appropriate electrical circuit means, cooperatively arranged to provide output signals having a characteristic parameter that is at least functionally related to the magnitude of the explosive forces imposed on the gun upon firing of an explosive charge carried thereby.

In the preferred manner of practicing the new and improved methods of the present invention with the above-described apparatus, following the advancement of the switching means to a given operating position constant-current DC source means and constant-current AC source means are temporarily connected across the cable conductors for obtaining simultaneous measurements respectively representative of the electrical resistance of the conductors as well as at least one identifiable measurement which is representative of the DC response of the one or more voltage-responsive means which are then actively associated with the switching means so as to reliably ascertain the present operating position of the switching means. Actuation of a given explosive charge then connected to the conductors by the switching means is carried out by temporarily connecting the cable conductors to a suitable electrical source. Upon actuation of each explosive charge on the gun, the resulting output signal from the impact-responsive transducer means is monitored for obtaining at least a visual indication which is functionally related to the characteristic parameter of the output signal and thereby allow a determination to be made as to whether that explosive charge had been satisfactorily detonated.

The novel features of the present invention are set forth with particularity in the appended claims. The invention, together with further objects and advantages thereof, may be best understood by way of the following description of exemplary methods and apparatus respectively employing the principles of the invention as illustrated in the accompanying drawings, in which:

FIG. 3 is a fragmentary view of only one portion of the circuitry of FIG. 2 to illustrate a minor modification thereto;

Figure 1:
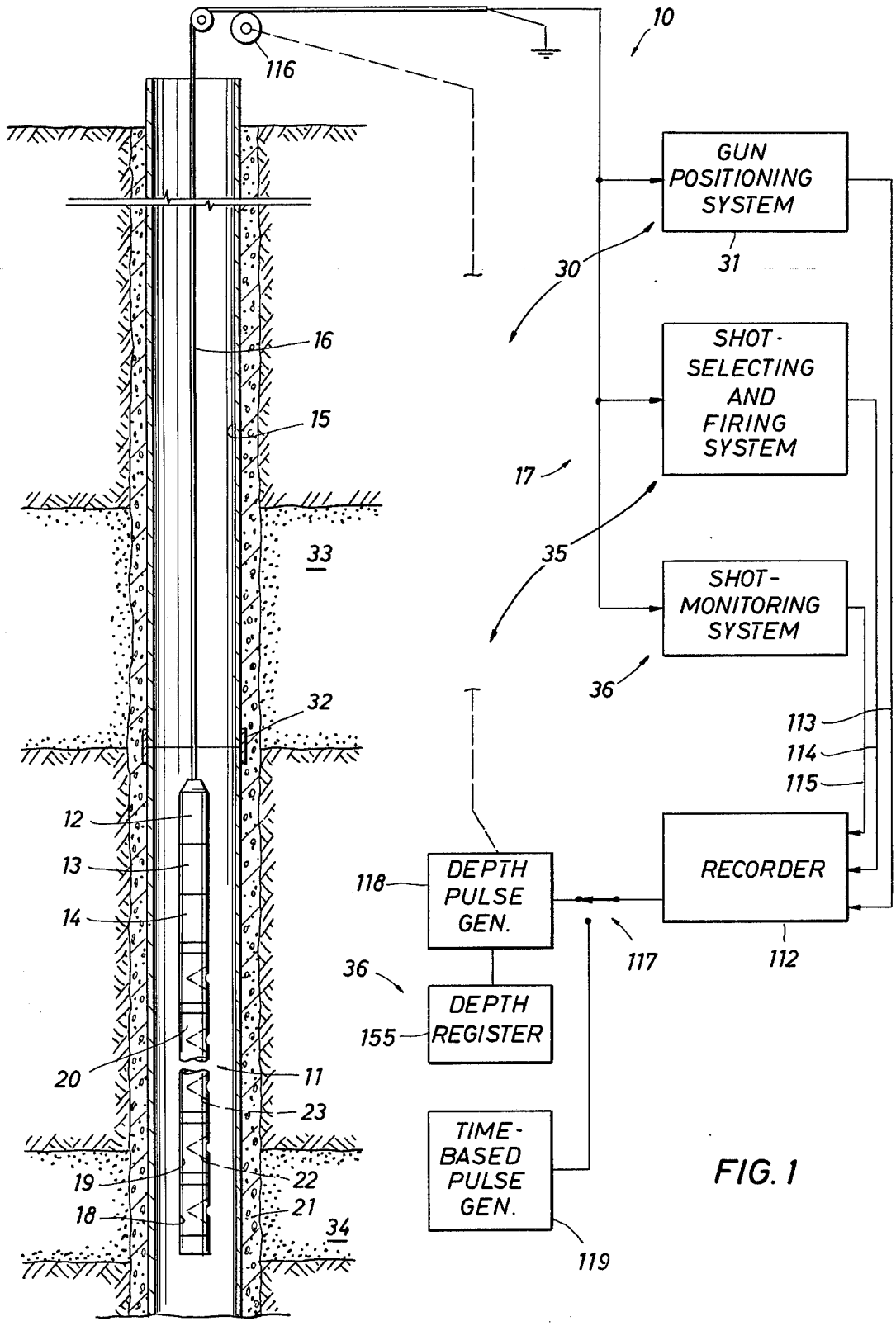
FIG. 1 depicts new and improved gun-control apparatus in accordance with the principles of the present invention and arranged on a typical perforating gun to show how the methods of the present invention may be employed for conducting a well-perforating operation.
Figure 7:
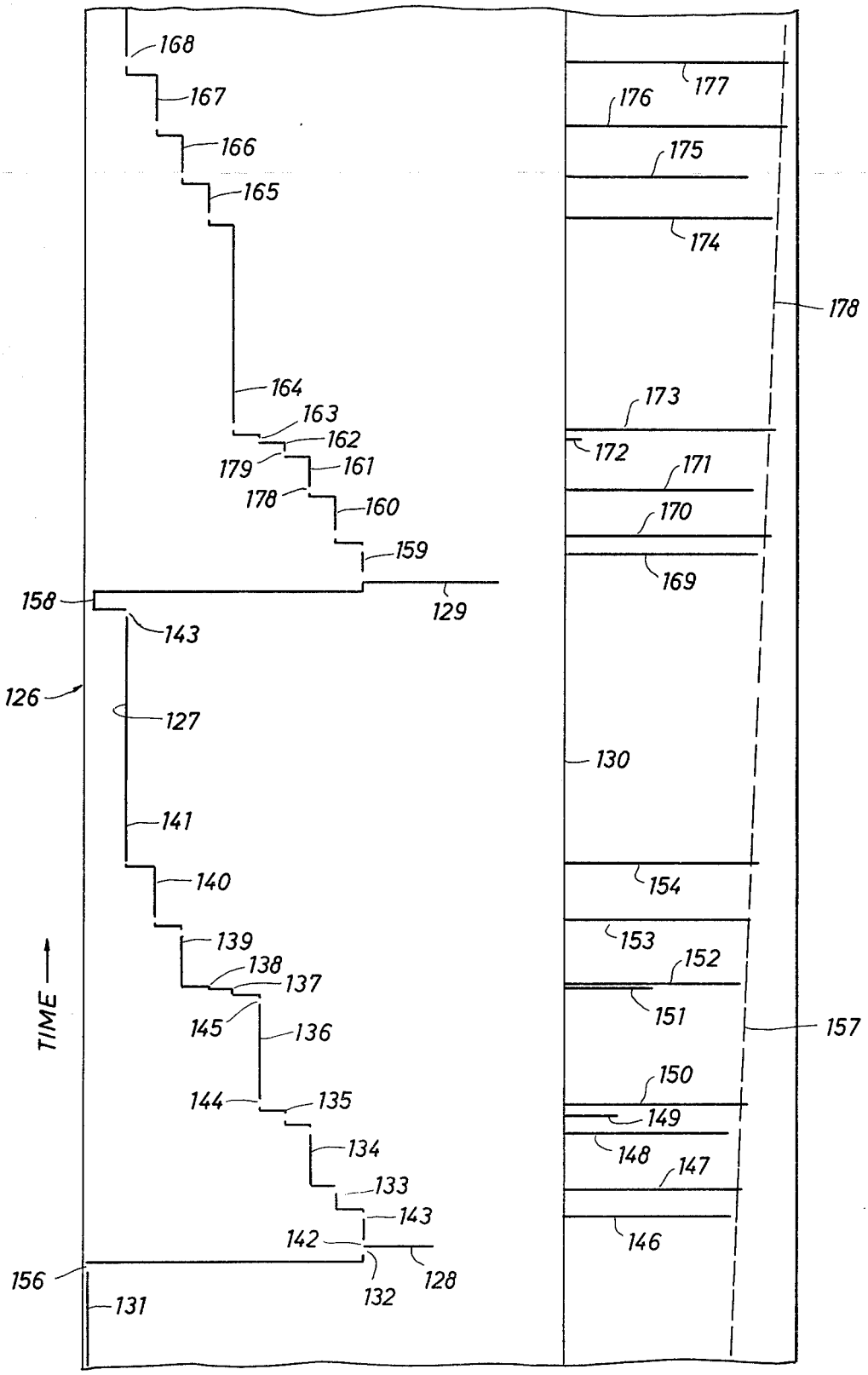

FIG. 5 shows those portions of the circuitry of the new and improved gun-control apparatus involved in monitoring the firng of a multi-shot gun assembly such as depicted in FIG. 1 as well as for providing surface indications from which it can be reliably determined whenever the charges on the gun assembly have been satisfactorily fired; and FIGS. 6 and 7 schematically depict typical records which the gun-control apparatus can readily provide during the practice of the methods of the present invention.

Turning now to FIG. 1, to illustrate a typical application of how the new and improved gun-control apparatus 10 of the present invention may be effectively employed in practicing the methods of the present invention, a multi-shot assembly 11 carrying the downhole portions of the control apparatus in one or more tandemly-disposed enclosed housings 12–14 is depicted suspended in a cased well bore 15 by means of a typical armored cable 16 that is spooled on a winch (not shown) adjacent to the well head at the surface and electrically connected to instrumentation, as shown generally at 17, representing the surface portions of the control apparatus. Although the selectively-fired gun 11 could just as well be either a formation-coring gun as shown in U.S. Pat. No. 3,202,227 or a non-expendable perforating gun as shown in U.S. Pat. No. 3,329,218, the depicted gun is a tandem assembly of expendable perforating carriers, as at 18–20, in keeping with those shown in U.S. Pat. No. 3,429,384. Rather than carrying a substantial number of charges as represented in the last-identified patent, the carriers, as at 18–20, incorporated in the gun assembly 11 are instead of relatively-short length and individually carry electrically-actuated explosive means such as only one, or perhaps two, shaped explosive charges, as at 21–23, that (as illustrated in FIG. 2) are operatively coupled by way of short pieces of explosive detonating cords 24–26 to typical electrically-responsive detonators 27–29.

As representatively depicted in FIG. 1, the gun-control apparatus 10 has a gun-positioning system 30 preferably including a typical collar locator and, if desired, a gamma-radiation detector which are respectively arranged in the tool housings 12 and 13 coupled by way of the cable 16 to associated amplifiers and other typical instruments, as shown generally at 31, which are included in the surface instrumentation 17. As is customary, the function of the gun-positioning system 30 is to provide output signals which facilitate the correlation of the depth locations of the casing collars, as at 32, and those earth formations, as at 33 and 34, having distinctive radioactivity characteristics. In this manner, the gun-positioning system 30 is effective for allowing the operator to bring the gun 11 to any one of many selected depth locations throughout the well bore 15 such as, for example, a first depth location where the shaped charge 21 in the lowermost carrier 18 will then be in position for perforating the well casing to gain communication with the adjacent earth formation 34. The gun-positioning system 30 will, of course, allow the operator to repeatedly position the gun assembly 11 at as many other different depth locations as may be required to accurately place one or more perforations in each of the several formation intervals, as at 33 and 34, intersected by the cased well bore 15.

The new and improved gun-control apparatus 10 further includes a shot selecting and firing system 35 arranged to facilitate the consecutive selection of successively-arranged shaped charges (as at 21, 22, or 23) for firing; and, after a given charge is selected, providing a verification signal showing that the designated charge is then in readiness for actuation so that the operator will be reasonably certain that the designated charge can be detonated. As will be subsequently explained in more detail, the gun-control apparatus 10 of the present invention also includes a new and improved shot-monitoring system 36 cooperatively arranged to provide another verification signal confirming that the previously-selected charge had indeed been successfully detonated by operation of the shot selecting and firing system 25.

Figure 2:
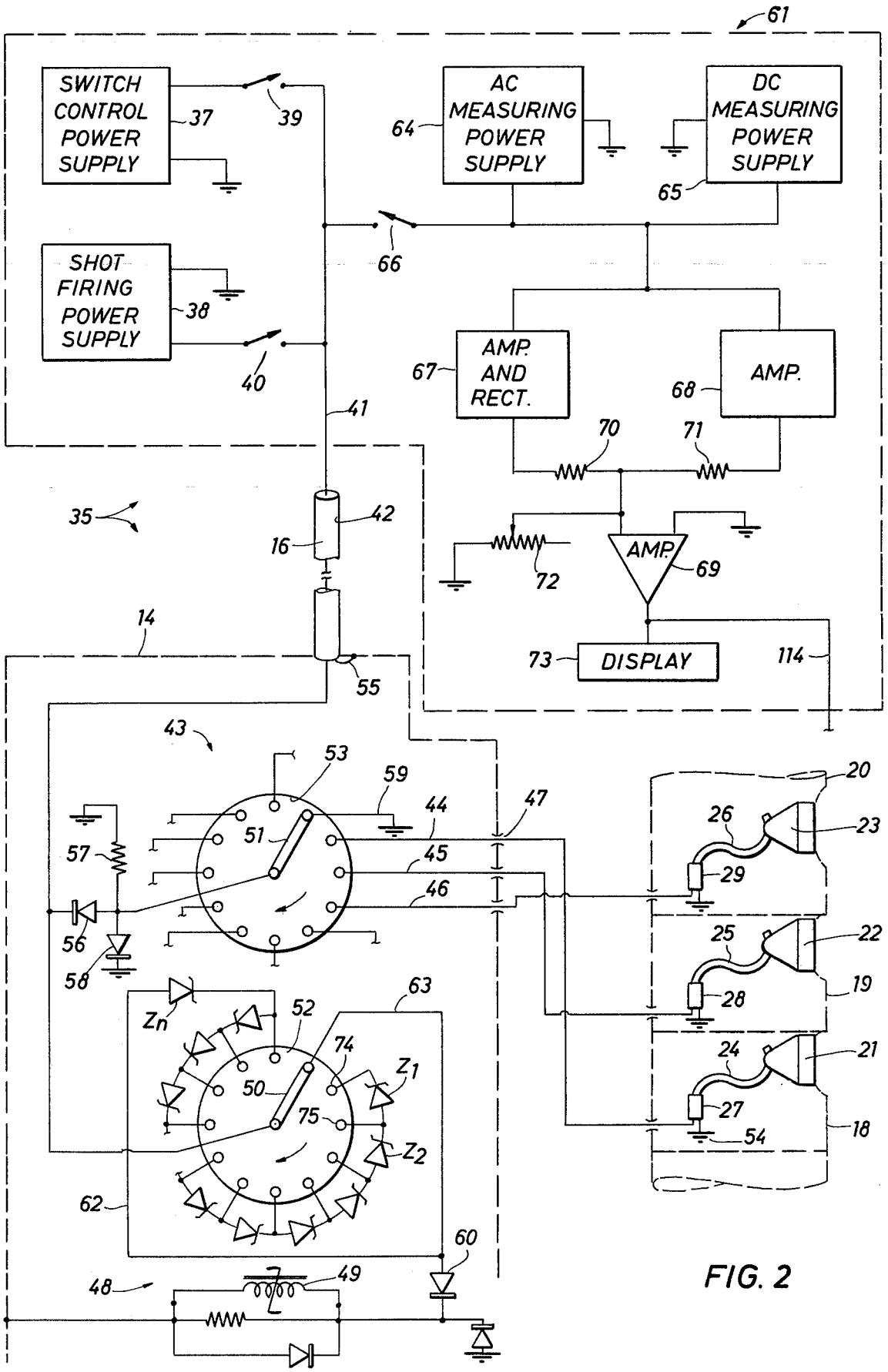
FIG. 2 shows those portions of one embodiment of electrical circuitry included with the new and improved gun-control apparatus depicted in FIG. 1 which is particularly suited for operating a limited number of explosive charges as well as for providing surface indications representative of which of the several charges carried by the depicted gun assembly is then in readiness for firing.

Turning now to FIG. 2, the somewhat-simplified circuit diagram shown there includes the surface and subsurface portions for one embodiment of the shot selecting and firing system 35 that may be used in the new and improved gun-control apparatus 10 of the present invention. The illustrated shot selecting and firing system 35 is particularly adapted for those situations where only a limited number of charges are to be selectively detonated in a given run; but, as will subsequently be explained by reference to FIG. 3, the principles of the present invention can also be readily incorporated for arranging expanded or duplicated alternative systems as may be needed to cover operations requiring the selective detonation of any number of explosive charges.

As illustrated in FIG. 2, that portion of the surface instrumentation 17 included in the shot selecting and firing system 35 employs electrical source means such as separate DC power supplies 37 and 38 which are selectively connectible, as by switches 39 and 40, to the surface end of the suspension cable 16 and cooperatively arranged for applying DC voltages of a selected potential level across the central conductor 41 and the outer armor 42 of the cable as well as for regulating and controlling the current flow through those electrical conductors. As is common for most perforating operations, the cable 16 has only the single inner conductor 41 and the outer armor sheath 42 to provide electrical communication between the surface instrumentation 17 and the gun assembly 11. Nevertheless, those skilled in the art will understand that the cable 16 could also be replaced with a cable having two or more internal conductors. In any event, as schematically illustrated, the subsurface portion of the shot selecting and firing system 35 is, for the large part, preferably arranged in a single module 43 that is sealingly enclosed in the tool housing 14. The module 43 is electrically connected to each of the enclosed carriers, as at 18–20, included in the gun assembly 11 by a corresponding number of electrical conductors as at 44–46 which, in the preferred embodiment of the gun assembly 11, are extended along the exterior of the carriers and respectively introduced into each carrier by way of a sealed feedthrough connector as at 47.

To accomplish its requisite selectiveness, the new and improved system 35 further includes switching means which, in the preferred embodiment of the new and improved gun-control apparatus 10, are comprised of a typical solenoid-actuated, multi-position switch assembly 48 mounted in the downhole module 43 and adapted to be operated upon closure of the switch 39 for selectively coupling the switch assembly to the switch-control power supply 37. The depicted switch assembly 48 has a solenoid-actuated indexing mechanism 49 arranged for sequentially stepping a ganged set of switch-contact arm 50 and 51 in unison between successive operating positions on their respective switch wafers 52 and 53. Although other types of commercially-available actuators can be alternatively employed in the system 35, the preferred indexing mechanism 49 has a pawl arranged to index a rotatable, multi-toothed ratchet wheel (neither shown) one incremental angular position upon each application of sufficient current to the solenoid actuator of the mechanism. The pawl remains in engagement with a given tooth on the wheel so long as the actuating solenoid of the mechanism 49 remains energized; and, upon de-energization of the solenoid, the pawl returns to its reset position for subsequently engaging the next-adjacent tooth. Since the contact arms 50 and 51 are operatively stepped in unison upon rotational movement of the unillustrated ratchet wheel, it will be appreciated that by successively energizing and de-energizing the solenoid of the mechanism 49 the contact arms will be progressively advanced around the spatially-disposed fixed switch contacts on their respectively-associated switch wafers 52 and 53.

In the preferred embodiment of the new and improved gun-control apparatus 10, the switch contact arm 51 and the contacts on its associated wafer 53 are cooperatively arranged for consecutively coupling the several detonators, as at 27–29, to the shot-firing power supply 38 so they may then be individually detonated one after another by successive closures of the control switch 40 in the surface instrumentation 17. To achieve this, the several electrical conductors, as at 44–46, are individually interconnected between the fixed contacts on the switch wafer 53 and one leg of whichever one of the detonators, as at 27–29, is chosen to be associated with a given one of the switch contacts. A return path for the detonators, as at 27–29, is conveniently provided by grounding, as at 54, the other leg of each detonator to the body of its respective carrier 18, 19 or 20 which is itself electrically connected, as at 55, to the cable armor 42 for completing the current path to the surface instrumentation 17.

To complete the downhole module 43 of the shot selecting and firing system 35 used for firing charges, as at 21–23, the lower end of the central cable conductor 41 is electrically connected to the rotatable switch contact 51 by way of selectively-oriented polarity-responsive means, such as a semi-conductor diode 56, arranged to pass current of only one selected polarity. A resistor 57 is also preferably connected between ground and the output side of the diode 56 to stabilize the firing circuit. Those skilled in the art will, of course, recognize that by orienting the diode 56 in relation to the polarity of the output terminal of the shot-firing power supply 38 and by connecting the output terminal of the switch-control power supply 37 to the cable conductor 41, the diode 56 will function to block current flow to the charge detonators 27–29 whenever the latter power supply is operated to step the solenoid-actuated indexing mechanism 49. As a matter of added safety, however, it is preferred to also have a reversely-oriented diode 58 permanently bypassing the switch contact arm 51 to ground as well as provide a temporary ground connection, as at 59, on the first as well as any other unused fixed contact positions on the switch wafer 53.

It will, of course, be recognized that it is strictly a matter of choice as to the polarity of the voltage used to step the indexing mechanism 49 and as to the polarity of the voltage used to actuate the detonators as at 27–29. However, to facilitate the explanation of the present invention, it is believed expedient to simply make an arbitrary assumption that it is the positive terminal of the switch-control power supply 37 and the negative terminal of the shot-firing power supply 38 which are respectively connected to the central cable conductor 41. On that basis, for simplifying the continued description of the present invention without suggesting a limitation as to its scope, as a matter of definition it can be said that the diode 56 is negatively oriented as illustrated so as to selectively pass current from the shot-firing power supply 38 but to block current flow between the detonators, as at 27–29, and the switch-control power supply 37 whenever the indexing mechanism 49 is being operated. Conversely, it can be similarly said that the diode 58, for example, is positively oriented and, as arranged, will function for shorting to ground unwanted current flowing between the switch-control power supply 37 and the detonators, as at 27–29, should the negatively-oriented diode 56 inadvertently fail or somehow become inoperative. With its depicted positive orientation, it will, of course, be recognized that ordinarily the diode 58 will not affect the flow of current between the shot-firing power supply 38 and the several detonators as at 27–29.

To provide for the selective operation of the indexing mechanism 49, the central cable conductor 41 is connected to the actuating solenoid of the mechanism by way of additional selectively-oriented polarity-responsive means such as a semi-conductor diode 60 reversely oriented in relation to the diode 56 for preferentially controlling current flow between the solenoid and the switch-control power supply 37. Although the switch assembly 48 could employ an additional wafer dedicated to simply maintain an electrical connection between the power supply 37 and the diode 60 so long as the several detonators, as at 27–29, are being consecutively coupled to the firing circuit, in the preferred embodiment of the new and improved gun-control apparatus 10 shown in FIG. 2 the switch wafer 52 is cooperatively arranged to maintain an electrical connection between the switch-control power supply and the indexing mechanism as well as to cooperate with a measurement circuit 61 arranged in the system 35 for providing signals at the surface to verify that the detonators are indeed being properly connected into the firing circuit. Accordingly, for reasons which will subsequently be explained, in its depicted preferred embodiment the measurement circuit 61 includes voltage-responsive means such as an array of serially-connected Zener diodes, as at $Z_1$–$Z_n$, which are respectively connected between all but the first of the several fixed contacts on the switch wafer 52 and the latter Zener diode is coupled to the input of the diode 60 by a conductor 62. Another conductor 63 connects the first fixed contact on the switch wafer 52 to the input of the diode 60 and the movable switch arm 50 is connected to the cable conductor 41.

With the switch wafer 52 and the serially-connected Zener diodes, $Z_1$–$Z_n$ arranged as depicted in FIG. 2, when the switch contact arm 50 is in its illustrated initial operating position it will be seen that the switch-control power supply 37 in the surface instrumentation 17 will be directly connected to the positively-oriented diode 60 and the initial closure of the switch 39 will be effective for advancing the movable switch contact 50 (as well as its companion contact arm 51) to its second operating position. Once, however, the switch contact arm 50 has been stepped to its second operating position, the entire array of the Zener $Z_1$–$Z_n$ will be serially coupled between the switch-control power supply 37 and the positively-oriented diode 60. Thereafter, as the switch contact arm 50 is progressively stepped to its consecutive operating positions spaced around the wafer 52, one Zener diode after another will be disconnected from the array $Z_1$–$Z_n$ until the switch arm reaches its final position leaving only the Zener diode $Z_n$ serially connected between the power supply 37 and the positively-oriented diode 60.

Before the operation of the switch assembly 48 is considered, it should be noted in passing that the switch assembly could instead be slightly modified so that the Zener diodes will be successively added to the measurement circuit 61 rather than successively being removed as is the case with the circuit depicted in FIG. 2. Thus, as shown by the fragmentary or partial view in FIG. 3, this alternative switch assembly 48' could be arranged with all of the Zener diodes $Z_1$–$Z_n$ in the array being connected across all of the fixed contacts on the switch wafer 52. Further, in this alternative arrangement, the cable conductor 41 is instead connected directly to the first fixed contact on the wafer 52 and the movable contact arm 50 is instead connected by a conductor 63' to the diode 60. With this alternative circuit arrangement 48', it will be recognized that successive advancement of the switch contact arm 50 will be effective for progressively adding Zener diodes in the array $Z_1$–$Z_n$ to the measurement circuit 61. As will be subsequently explained, it will be seen that both of these two circuit arrangements are clearly in keeping with the scope of the present invention.

Referring again to FIG. 2, it will be appreciated that at any given position of the switch arm 50, the power supply 37 must be adjusted as required to override the combined Zener levels of however many of the Zener diodes $Z_1$–$Z_n$ which are then actively connected between the switch-control power supply and the solenoid mechanism 49. This generally poses no significant problem since the level of voltage required for properly operating the solenoid mechanism 49 is ordinarily much greater than the combined total of the respective Zener levels of the diode array $Z_1$–$Z_n$. Those skilled in the art will appreciate, however, that even should the combined Zener level of the diodes $Z_1$–$Z_n$ be significant in relation to the recommended operating voltage for the solenoid mechanism 49, the switch assembly 48 could nevertheless be selectively operated by appropriately controlling the power supply 37. In either case, selective operation of the switch assembly 48 is easily carried out by temporarily closing the switch 39 and operating the power supply 37 as required to operate the indexing mechanism 49 for successively advancing the contact arms 50 and 51. Then, upon opening of the switch 39, the indexing mechanism 49 will be reset and placed in readiness for simultaneously advancing the contact arms 50 and 51 respectively to their next operating positions upon reclosure of the switch 39.

Although the array of Zener diodes $Z_1$–$Z_n$ functions to make the solenoid mechanism 49 operative only in response to a voltage potential in excess of the combined total Zener level of the diodes then actively connected to the mechanism, as previously mentioned the primary purpose of the diode array is instead to provide verification signals at the surface individually representative of which of the several charges, as at 21–23, is then connected in the firing circuit of the gun assembly 11. To accomplish this, the measurement circuit 61 includes electrical source means which, in the preferred embodiment of the present invention, are comprised of a constant-current AC supply 64 and a constant-current DC supply 65 which are connected to one another and selectively coupled across the cable conductors 41 and 42, as by a switch 66, as well as respectively connected to the inputs of suitable processing circuitry such as an AC amplifier 67 and a DC signal conditioner or amplifier 68. The outputs of the amplifiers 67 and 68 are combined and coupled to the input of a summing amplifier 69 by way of a resistive network, as at 70–72, arranged to normalize the combined output signals from the amplifiers. The output of the summing amplifier 69 is, in turn, coupled to suitable indicating means such as a typical digital output meter 73.

Accordingly, it will be realized that with respect to the constant-current DC supply 65, when the switch 66 is closed the resulting output voltage of that power supply will be equal to the summation of the DC IR drop in the cable 16, the DC IR drop in the solenoid of the indexing mechanism 49, and the combined or cumulative Zener level of only those of the Zener diodes, $Z_1$–$Z_n$, which are then serially connected by the switch arm 50 to the cable conductor 41. It will be seen also that, with all else being equal, whenever the switch contact arm 50 is in its illustrated initial position, the output voltage of the DC supply 65 will be the summation of only the combined IR drops in the cable 16 and the solenoid of the indexing mechanism 49. On the other hand, as the switch contact arm 50 is indexed to its first active switching position, the DC voltage appearing across the input of the amplifier 68 will then be at an initial maximum equal to the summation of the aforementioned IR drop and the cumulative total of the Zener levels of all of the Zener diodes $Z_1$–$Z_n$ in the Zener array. Thereafter, as the switch contact arm 50 is consecutively indexed around its remaining active switching positions, this output voltage will be progressively decreased at each step by an amount equal to the Zener level of the Zener diode, such as at $Z_1$, which was just removed from the measurement circuit 61 by advancement of the contact arm, as from the first active contact position 74 to its next active position 75. Ultimately, as the contact arm 50 reaches its final contact position, the final DC output voltage will be equal to the total of the aforementioned DC IR drop in the cable 16 and the solenoid mechanism 49 and the Zener level of the last Zener diode, $Z_n$.

On the other hand, the constant-current AC supply 64 is affected little, if any, by the serially-arrayed Zener diodes $Z_1$–$Z_n$. Inasmuch as the AC output current from the supply 64 is superimposed on the DC output current from the supply 65, the resulting output voltage of the AC supply will be equal only to the combined AC IR drop in the cable 16 and the indexing mechanism 49. Since the DC voltage is effective for biasing the Zeners to conduct, the minor IR drop in the still-active diodes in the array $Z_1$–$Z_n$ may, from a practical standpoint, be safely ignored. Thus, by choosing the resistors 70–72 as needed to normalize the AC and DC IR drop input signals supplied to the summing amplifier 69, that amplifier can be readily adjusted to provide an output signal which is solely a function of the total Zener levels of only those of the diodes $Z_1$–$Z_n$ which are then actively connected into the measuring circuit 61. In other words in the peferred embodiment of the present invention, the resistors 70–72 are cooperatively selected to completely balance or offset the resulting voltage from the AC supply 64 with that portion of the output voltage from the DC supply 65 attributed to the combined DC IR drop in the cable 16 and the indexing mechanism 49. As a result, since the output of the amplifier 69 is always representative of the number of the Zener diodes $Z_1$–$Z_n$ actively in the measuring circuit 61, the signal appearing on the output device 73 will be representative of the successive positions of the contact arms 50 and 51 as the switch assembly 48 is consecutively indexed. It will, of course, be realized that the output device 73 can be calibrated as desired for providing a convenient visual display to show which of the several charges, as at 21–23, in the gun assembly 11 is then in position for firing.

It should, of course, be recognized in passing that the switch assembly 48 will, in effect, operate completely opposite to the alternative arrangement shown in FIG. 3. With this alternative arrangement 48', it will be seen that upon progressive stepping of that switch assembly the combined Zener level of the array $Z_1$–$Z_n$ will instead be progressively increased to define successive distinctive steps of the measured voltages as additional diodes in the diode array are added to the measurement circuit 61. Thus, the final DC output voltage with the alternative system shown in FIG. 3 will instead be equal to the summation of the combined DC IR drop in the electrical path and the total Zener level of the entire diode array $Z_1$–$Z_n$.

Figure 4:
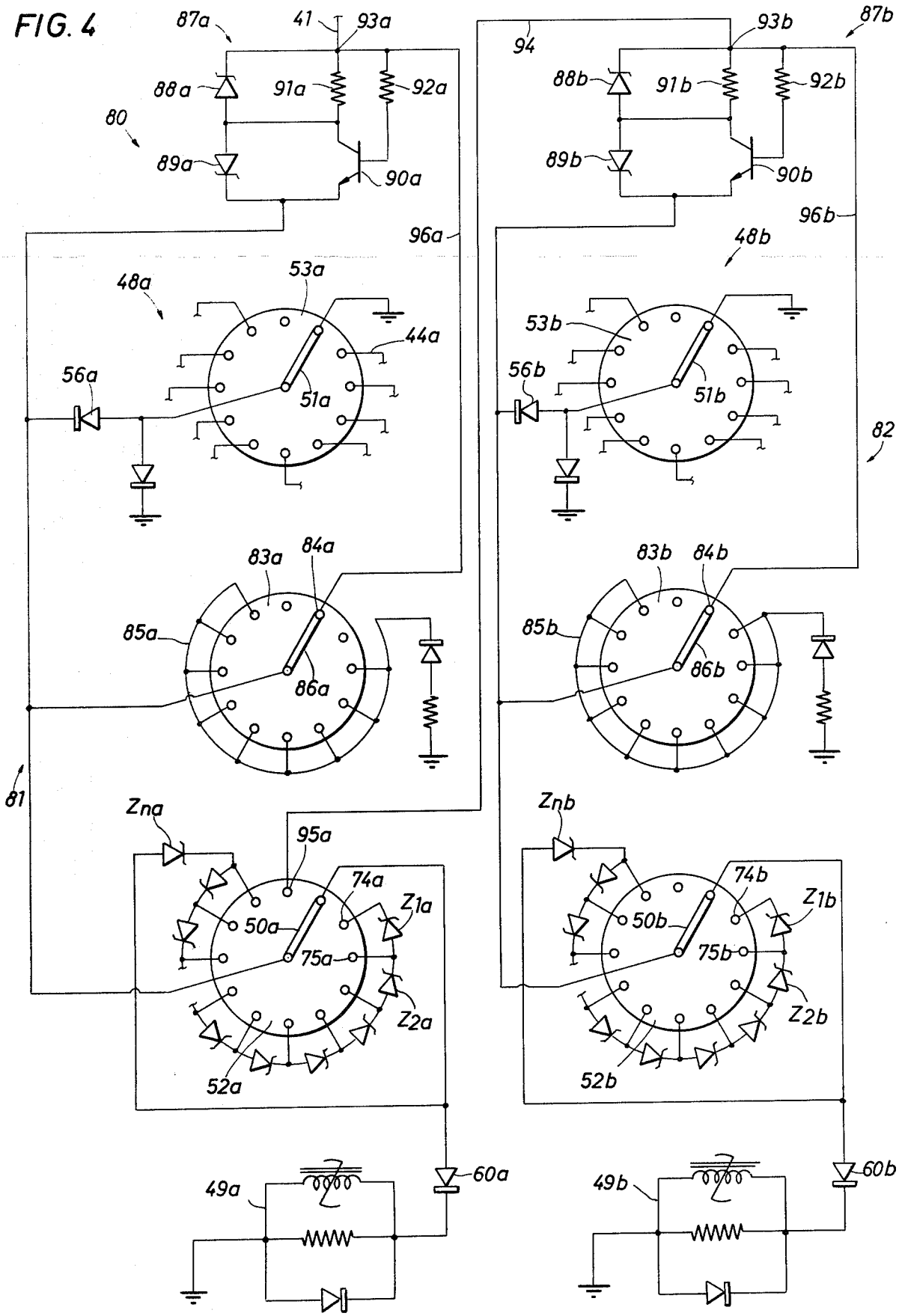
FIG. 4 illustrates a further modification of the circuitry shown in FIG. 2, with this modified circuitry being particularly arranged for utilization where a larger number of explosive charges are to be successively operated.

It is, of course, not at all uncommon to encounter well-completion operations where the number of explosive devices which are to be selectively detonated exceeds the number of available switching positions that may be conveniently accommodated with a single switch assembly such as at 48. Accordingly, to demonstrate how the principles of the present invention may be effectively incorporated for utility in such situations, FIG. 4 illustrates a preferred embodiment of only the subsurface portion of an alternative shot firing and selecting system 80 which (but for one exception to be later described) is fully compatible with the surface instrumentation 17 for the system 10 previously described by reference to FIG. 2. A gun assembly (as at all in FIG. 1) is arranged as depicted in FIG. 4 to include one module 81 (shown only in FIG. 4) in the lower part of the gun assembly and at least one additional module 82 (shown only in FIG. 4) in a higher or intermediate part of the gun assembly.

It will, of course, be recognized by comparison of FIGS. 2 and 4 that the majority of the various circuit elements in the downhole module 43 of the previously-described system 35 have been identically or similarly employed in the alternative multi-gun system 80 and that these elements are simply duplicated as required to accommodate the increased number of explosive devices that need be fired. In view of the identity or close similarity in many of the circuit elements employed in the two systems 35 and 80 and since it will facilitate the forthcoming description of the alternative system, components in the downhole portion of that system essentially corresponding to a componenet in the previously-described system will carry the same reference numeral as previously used but with an added suffix letter such as "a" to designate a component in the first module 81 and an added suffix letter "b" to designate the same component in the second module 82.

Although a switch assembly, as at 48, could be readily used in each of the modules 81 and 82, it is instead preferred to employ an alternative switch assembly, such as at 48a and 48b, for the new and improved shot firing and selecting system 80. As depicted, the switch assemblies 48a and 48b are identical to the previously-described assembly 48 except that each alternative switch assembly preferably includes an additional multi-contact wafer, as at 83a and 83b, having a separate first fixed contact 84a and 84b as well as a common uninterrupted contact or a set of serially-interconnected contacts, as at 85a and 85b, respectively arranged for successive engagement by the switch contact arms 86a and 86b as they are consecutively stepped around the additional wafers by repetitive operation of their solenoid-actuated indexing mechanisms 49a and 49b.

As illustrated in FIG. 4, voltage-actuated, polarity-responsive indicating means, as shown generally at 87a and 87b, are respectively connected in series with each of the switch assemblies 48a and 48b. A set of serially-connected, reversely-oriented Zener diodes 88a and 89a (as well as 88b and 89b) is shunted by a solid-state switch such as may be conveniently provided by a typical NPN transistor 90a (and 90b) having its emitter connected to the negative pole of the Zener diode 89a and its collector connected to the common junction of the positive poles of the Zener diodes 88a and 89a. With the depicted arrangement, the desired switching operation of the transistors is, therefore, respectively achieved by a first set of resistors 91a and 92a which connect the collector and base of the transistor 90a to a common junction 93a with the cable conductor 41 and a second set of resistors 91b and 92b which connect the collector and base of the other transistor 90b to a common junction 93b with an interconnecting conductor 94 connected to the final fixed contact 95a on the switch wafer 52a. Although it is not essential, it is preferred that the indicating means 87a and 87b be shunted so long as the switch assembly 48a (or 48b) respectively associated therewith is still in its initial operating position. In the preferred manner of shunting the indicating means 87a and 87b, conductors 96a and 96b are respectively connected between the first fixed contact 84a and 84b on the switch wafers 83a and 83b and the junctions 93a and 93b. The purpose of this shunting arrangement will be subsequentially explained.

With the two downhole modules arranged as illustrated in FIG. 4, it will be appreciated that, but for one exception, the surface instrumentation 17 shown in FIG. 2 can be readily employed for operating the two multi-gun modules 81 and 82 in much the same manner as previously described with respect to the single-unit module 43. For example, selective operation of the solenoid-actuated indexing mechanisms 49a and 49b is carried out in the same manner as when the single-unit module 43 is operated. Accordingly, the initial actuation of the switch assembly 48a in the first module 81 is achieved by simply closing the switch 39 at the output of the switch-control power supply 37 (both seen only in FIG. 2) so as to apply a voltage across the cable 16 with the positive pole of the power supply being connected to the central cable conductor 41. The first time a positive voltage is applied to the cable conductor 41 and at a current level sufficient to operate the indexing mechanism 49a, the movable switch arm 50a will function to connect the solenoid-actuator of the mechanism to the cable conductor by way of the positively-oriented diode 60a.

It will be recognized also that in the depicted initial switching position of the switch assembly 48a, the switch arm 86a and the conductor 96a provide a shunt around the indicating means 87a. Moreover, the other switch assembly 48b will remain inactive so long as the switch assembly 48a is being indexed since the conductor 94 leading to the other switch assembly will be connected to the cable conductor 41 only when the switch contact arm 86a reaches its final fixed contact position on the wafer 83a. Thus, successive applications of voltage from the switch-control power supply 37 will be effective for progressively indexing the switch assembly 48a through its several positions and finally connecting the second switch assembly 48b to the cable conductor 41 as the first switch assembly is simultaneously disconnected from the cable conductor. Once the second switch assembly 48b is coupled to the cable conductor 41 by the switch arm 86a, it will, of course, then begin to function in the same manner as the surface switch 39 continues to be repetitively operated.

It should be noted that once the switch assembly 48a is indexed to its second position, the contact arm 86a is no longer shunting the indicating means 87a. Thus, with the depticted arrangement of the reversely-oriented Zener diodes 88a and 89a and the NPN transistor connected thereto, a positive voltage on the cable conductor 41 will be effective for biasing the transistor 90a to conduct once the current is high enough to turn on the transistor. The effective level of that biasing current is, of course, determined by the value of the base resistor 92a (as well as 92b). Thus, in the preferred arrangement of the indicating means 87a, this resistance value is selected so that the transistor 90a will conduct to act as a switch at all levels of positive current normally expected during the practice of the invention. The resistance value of the other resistor 91a (as well as 91b) is ordinarily somewhat lower; and it is selected to be of sufficiently-low resistance that low-level current can be passed through the resistor without causing the Zener diode 88a to conduct.

Accordingly, with a positive voltage on the cable conductor 41, it will be seen that the transistor 90a will be on; but the Zener 88a will not conduct at low levels of current. Thus, at such low levels of measurement currents, the current path will be through the resistor 91a and the transistor 90a so as to present only a minimum IR drop across the indicating means 87a whenever the switch position of the switching assembly 48a is to be determined. On the other hand, where there is a positive-polarity voltage on the cable conductor 41, and the current level is indicated, the Zener 88a will conduct so as to maintain a constant voltage drop of a selected magnitude across the indicating means 87a whenever one of the indexing mechanisms 49a or 49b is being stepped.

The indicating means 87a and 87b are further operable for providing detectable signals in response to low-level current flows whenever the cable conductor 41 is at a negative polarity. Thus, by coupling a conventionally-arranged polarity-reversing switch (not shown in the drawings) across the output terminals of the DC measuring power supply 65, its positive terminal can be alternatively grounded and its negative terminal instead connected to the cable conductor 41 whenever it is desired to obtain a surface measurement indicative of the Zener level of the Zener 89a (and 89b). The NPN transistor 90a will, of course, not conduct when the cable conductor 41 is at a negative polarity. Thus, it will be realized that its higher current levels, such as when an explosive device is to be actuated, the Zener 89a will effectively conduct and the voltage drop thereacross will be minimal.

By comparison of FIG. 2 with FIG. 4, it is, of course, quite evident that firing of various explosive devices by means of the modules 81 and 82 is carried out in the same manner as with the single module 43. Accordingly, upon successive closures of the control switch 40 at the surface, the negative terminal of the shot-firing power supply 38 will be correspondingly connected to the central cable conductor 41 for detonation of whichever explosive device is then connected to the cable conductor by way of either the switch assembly 48a or the switch assembly 48b. It should be noted in passing that as the several explosive devices are being fired, the reversely-oriented Zener diodes 88a and 89a (as well as 88b and 89b) function to conduct the firing current since the NPN transistor 90a (as well as 90b) will not conduct with a negative polarity on the cable conductor 41.

Those skilled in the art also recognize that as the measurement circuit 61 (shown only in FIG. 2) is operated with the shot selecting and firing system 80 depicted in FIG. 4 for monitoring the successive positions of the shot-selecting switch contact arms 50a and 50b, the Zener diode arrays, $Z_1$–$Z_n$ around the wafers 52a and 52b will respectively function in the same manner as previously described with respect to the corresponding array on the single module 43. Hereagain, by coupling the AC supply 64 and the negative terminal of the DC supply 65 to the cable conductor 41, measurements indicative of the respective positions of the switch contact arms 50a and 50b are readily attainable since the reversely-oriented diodes 88a and 89a (as well as 88b and 89b) cooperate to pass the superimposed DC and AC currents without difficulty.

Accordingly, from the preceding discussions, it will be appreciated that the multiple-gun modules, as at 81 and 82, will respectively operate in the same manner as the single-gun module 43 as previously described. That is to say, when the present position of the switch contact arms, as at 51a or 51b, is to be determined, the surface control switch 66 is closed at least momentarily so as to couple the positive terminal of the DC supply 65 of the measurement circuit 61 to the cable conductor 41. At the resulting low level of measuring current, the Zener 88a will not conduct and the measurement presented on the display device 73 will be a function of however many of the Zeners $Z_1$–$Z_n$ on the wafer 52a (or 52b) are then effectively connected into the measurement circuit 61. In a similar fashion, stepping of the indexing mechanism 49a (or 49b) is carried out in the same manner as with the single-arm module 43 by simply closing the surface switch 39 thereby connecting the positive terminal of the switch-control power supply 37 to the cable conductor 41. As just described, at that higher level of current, the transistor 90a (or at 90b) will effectively shunt the Zener 89a to minimize the overall IR drop in the stepping circuit as the indexing mechanism 49a (or 49b) is being stepped. Again, as just described, selective firing of a plurality of explosive devices is carried out with the multi-gun modules 81 and 82 by simply closing the surface switch 40 for briefly connecting the shot-firing power supply 38 to the cable conductor 41. At such higher levels of current, the Zener diode 89a (or 89b) will limit the overall IR drop in the firing circuit as the explosive devices are being fired.

The indicating means 87a and 87b are, therefore, effective for providing characteristic indications at the surface which are representative of which of the several gun modules, as at 81 or 82, is then connected to the surface instrumentation 17 and is in readiness for operation for firing of the next-available explosive device. For instance, so long as the switch assembly 48a in the first module 81 is being selectively indexed, the first indicating means 87a will provide a surface measurement which gives a "zero" reading when the contract arm 50a is in its first position and a series of readings respectively representative of the combined Zener level of the Zener diodes $Z_{la}$–$Z_{na}$ still in the measurement circuit 61 as the switch assembly 48a is being successively indexed. Then, once the contact arm 50a reaches its final position 95a, the cable conductor 41 is permanently disconnected from the indexing mechanism 49a and instead connected to the indexing mechanism 49b. In the preferred embodiment of the multi-gun modules 81 and 82, when the switch assembly 48a moves beyond its initial position the indicating means 87b will then be in series with the other indicating means 87a so that the corresponding measuring signal will be approximately equal to the combined Zener levels of the Zener diode 88a and the Zener diode 88b. It will, therefore, be realized that by virtue of the Zener diodes 88a and 88b, the measurement circuit 61 functions to provide characteristic signals at the surface which are indicative of which of the several control modules, as at 81 and 82, is then coupled to the cable 16 and is in readiness for firing.

As previously discussed, ordinarily it is of no particular difficulty to reposition a gun and actuate the next-available explosive device should the initially-selected device fail to operate for some unexpected reason. It will also be recognized from the preceding discussion that either of the new and improved shot selecting and firing systems 35 and 80 as respectively described with reference to FIGS. 2, 3 or 4 can be employed with equal success for accurately determining which of the several available explosive devices is then connected to the firing circuit. Accordingly, as a further aspect of the new and improved gun-control apparatus 10 depicted in FIG. 1, the shot-monitoring system 36 of the present invention is also cooperatively arranged for providing output signals upon actuation of the explosive devices on the gun assemblies as at 18, 19 or 20 with these signals each being functionally representative of the relative magnitude or severity of the resulting explosive shock. As will be described, by virtue of these signals, it can be reliably determined whether the explosive devices have properly detonated and, at least to some extent, whether the explosive devices are being actuated in the selected order.

In contrast to the prior-art systems described previously, in the preferred embodiment of the new and improved shot-monitoring system 36 depicted in FIG. 5, an acceleration-responsive transducer such as piezoelectric crystal 100 along with suitable downhole electrical circuitry (as shown generally at 101) is mounted within a housing 102 of a gun assembly and cooperatively arranged for producing output signals which, in contrast to the above-mentioned Brock system, last for a time interval that is functionally related to the severity or magnitude of the impact imparted to the crystal each time an explosive device on the associated gun assembly is actuated. In the preferred embodiment of the downhole circuitry 101, the crystal 100 drives an amplifier 103 which is coupled by way of a peak detector 104 to a rectifier such as diode 105. The output of the rectifier diode 105 is coupled by way of a typical RC circuit 106 to the input of a voltage-sensitive circuit, such as a Schmitt trigger 107, cooperatively arranged for driving an oscillator 108. As would be typical, the surface instrumentation of the shot-monitoring system 36 includes a detector 109 which is connected by way of an amplifier 110 to a suitable output display device 111.

It will be appreciated that by virtue of the RC circuit 106, the oscillator 108 will produce output signals on the cable conductor 41 of a relatively-constant amplitude over an operational time period that is directly related to the time required for the RC circuit to be discharged to a selected level. Since the discharge period of the RC circuit 106 is directly related to the initial electrical charge stored by the RC circuit, the aforementioned operational time period in each instance is wholly dependent upon the peak voltage produced by the crystal 100. The output voltage of the crystal 100 is, of course, a direct function of the magnitude of the mechanical force or impact to which the crystal is subjected in response to the actuation of any explosive device associated with the downhole housing 102.

Accordingly, it will be appreciated that the actuation of an explosive device on a gun assembly associated with the crystal 100 will subject the crystal to an accelerative force which is directly related to the severity of that explosive force as well as to the physical separation between the explosive device and the crystal. Assuming, therefore, that the explosive devices on a given gun assembly are substantially identical to one another, it will be seen that as each charge is satisfactorily detonated the corresponding output signals of the circuitry 101 will each be for a time period that is functionally related to the physical distance between the crystal 100 and the explosive device that was just detonated. Thus, looking at FIG. 1 for a moment and assuming that the crystal 100 is mounted in the gun housing 14, whenever a remotely-situated explosive device (such as the shaped charge shown at 21) is detonated the display as presented by the output device 111 will represent that the output signal from the downhole circuitry 101 had lasted for only a relatively-short period of time. On the other hand, it has been found that whenever an explosive device in the near vicinity of the crystal 100 is detonated, the resulting output signal produced by the circuitry 101 will last for a time period which is somewhat greater in length. Accordingly, in the practice of the present invention, it has been found that by mounting the crystal 100 near the upper end of a given gun assembly (such as shown at 11 in FIG. 1), a series of output signals lasting for different time durations will be received on the display device 111 as the several explosive devices spatially disposed on the assembly are respectively fired. Since it is customary to operate a gun assembly, as at 11, so that the bottommost charge, as at 21, on the assembly is fired first, the successive output signals provided by the downhole circuitry 101 will, at least for the large part, be of a slightly longer duration than those signals produced as the charges on the assembly which are closer to the crystal 100 are also satisfactorily fired.

It should be recognized that the duration of any given output signal produced by the circuitry 101 is also affected by such unpredictable variables as the overall rigidity of the gun assembly 11, the particular well bore conditions, and the inherent minor differences in the explosive forces produced by the respective charges 21–23. As a result, assuming typical statistical variations, ordinarily little, if any, distinction will be observed between the output signals produced when charges lying close to one another are fired. Thus, since there is ordinarily sufficient variations between the respective output signals produced by firing of any given group of immediately-adjacent charges, it cannot be conclusively established that the output signal occurring upon firing of a more-distant charge, as at 21, will always be for a shorter time duration than the output signal produced upon firing of an immediately-neighboring but less-distant charge as at 22 or 23. Nevertheless, as will be subsequently shown by reference to FIG. 5, the successive output signals produced by the circuitry 101 will at least tend to be of a progressively-longer duration as those charges closer to the crystal 100 are fired. Thus, as a general point of reference, the new and improved shot-monitoring system 36 is readily adaptable for providing a series of output signals from which it can at least be confirmed that a given set of explosive charges are being successively fired in the same predetermined order as is being simultaneously indicated by the new and improved shot selecting and firing system 35 of the present invention.

It is, however, of far greater significance to recognize that the new and improved shot-monitoring system 36 of the present invention is particularly suited to provide output signals from which it can be reliably determined whether or not a given explosive charge has been properly detonated. For instance, as is well known by those skilled in the art, when sufficient electrical current is applied to a detonator, such as at 27, the detonator must do one of three things—either it must explode at or near its design capacity, or it must explode at some unsatisfactory reduced or low-order level, or on rare occasions the detonator will fail to explode at all. Similarly, a given length of detonating cord, as at 24, or a given shaped charge, such as at 12, may also fail to detonate as designed. Thus, despite the usual reliability of those components comprising a typical set of commercially-suitable explosive means, unexpected failures will nevertheless occur, with the result of such failures being that a particular shaped charge, such as at 21, either will fail to explode at all or the charge will undergo a so-called "low-order" detonation. Regardless of the nature of the failure, the perforating operation is either not completed or it is inadequately performed.

It will be appreciated, therefore, that with any particular set of explosive means (such as the shaped charge 21, the detonating cord 24, and the detonator 27), the explosive forces which will be imposed on the gun assemblly 11 upon actuation of the detonator can be either zero, or at some intermediate level should any of these three explosive components fail to perform at its expected capacity, or at a maximum-possible level upon high-order detonation of the shaped charge. In the usual situation, the high-order detonation of a shaped charge, as at 21, will be of considerably greater force than the force occurring either upon a low-order detonation of the shaped charge itself or upon a detonation of any character of the other two explosive components which fails to properly detonate the shaped charge.

It should also be recognized that there are many different levels of explosive forces which will be developed by different sizes of charges on a given gun assembly as at 11. Similarly, the number of shaped charges which are set off at any given time will determine the magnitude of explosive forces acting on the gun assembly 11. It will be realized, therefore, that the intensity of explosive forces acting upon a gun assembly, as at 11, can be over such a wide range that, as a practical matter, even modern detonation-responsive systems such as shown in the aforementioned Brock patent cannot be fully relied upon as being a suitable detonation monitor. For instance, in typical field operations it is not at all unusual for one gun assembly, as at 11, to be arranged as shown in FIG. 1 with a series of charges which are to be fired one at a time while another gun assembly is arranged as a series of individual carriers respectively having several shaped charges. As a result, it will be appreciated that the explosive force developed by detonation of a single shaped charge in a short carrier in the gun assembly 11 could easily be of comparable magnitude to the explosive force developed by a long piece of detonating cord in a multi-shot carrier in another gun assembly. Similar comparison will also arise between gun assemblies using different styles or sizes of shaped charges. Those skilled in the art will, of course, readily appreciate the impracticality of even attempting to properly adjust the threshold level of a system as described in the aforementioned Brock patent for use with every possible combination of explosive means which will typically be encountered in usual field operations.

Accordingly, the new and improved shot-monitoring system 36 of the present invention is cooperatively arranged for providing output signals from which it can be reliably ascertained whether a set of explosive devices has been properly fired irrespective of the particular arrangement or configuration of the gun assembly as at 11. It should also be kept in mind that since the output signals from the shot-monitoring system 36 are directly related to the intensity of a given explosive force, comparison of the output signals produced on the display device 111 by successively-detonated explosive devices will always be sufficient to confirm whether these explosive devices are being detonated properly. For example, either a misfire or the inadequate detonation of a given explosive device on a gun assembly, as at 11, will be readily detected by simply comparing the output signal produced upon firing of that device with the output signal produced upon firing of another explosive device on the assembly. This comparison can, of course, be made quite readily by successively observing the display device 111; and reliable comparisons can be had either by observing the readings produced by the detonation of immediately-adjacent explosive devices or by observing those readings produced by the detonation of even more distant explosive devices.

Comparison of the output signals produced by the shot-monitoring system 36 is, of course, easily done by simply observing the successive displays which are provided by the display device 111. However, those skilled in the art will appreciate that more-effective comparisons can be had by recording the output signals from the shot-monitoring system 36 as well as the output signals provided by the shot selecting and firing system 35 and then correlating these recordings to determine whether a given operation is proceeding as expected.

Accordingly, as schematically represented in FIG. 1, recording means are provided such as a typical galvanometer-type or CRT recorder 112 having multiple inputs connected, as at 113–115, to the surface elements of the several systems 31, 35 (or 80) and 36 with the recorder being arranged as required for individually recording various electrical output signals on suitable recording media such as a movable roll of film which is progressively advanced through the recorder as a function of either time or depth. As is common, the surface instrumentation 17 includes a depth-measuring wheel 116 arranged in a typical fashion to utilize the travel of the cable 16 for progressively driving film through the recorder 112 in proportion to the movements of the gun assembly 11 in the well bore 15. In this manner, the recorder 112 is able to provide a log record of the output signals from the gun-positioning system 31 showing the depth locations of the respective collars, as at 32, as well as of the earth formations as at 33 and 34. Inasmuch as it is also preferred to obtain a record of the output signals from the shot selecting and firing system 35 and the shot-monitoring system 36, the recorder 112 is arranged to be selectively coupled, as by a switch 117, to either a suitable depth-pulse generator 118 driven by the measuring wheel 116 or a suitable time-based pulse generator 119.

Thus, when the gun assembly 11 is being positioned in the well bore 15 and the depth-pulse generator 118 is connected to the recorder 112, the resulting film record will be a typical depth-based record or log. Conversely, when the gun assembly 11 has been positioned at a selected depth and is ready to be fired, the switch 117 is actuated to connect the pulse generator 119 to the recorder 112 for producing a time-based log record of the forthcoming perforating operation.

Accordingly, as schematically represented in FIG. 6, a typical depth-based log record 120 is presented for illustrating the log that will be produced by the recorder 112 as the gun assembly 11 is being lowered in the well bore 15 and positioned so as to locate the lowermost shaped charge 21 in the gun assembly opposite the formation 34. As is customary, the log 120 is provided with a series of depth marks 121 and periodic depth readings as at 122. The movements of the cable-driven measuring wheel 116 are, of course, effective for driving the depth-pulse generator 118 so as to properly synchronize the movements of the gun assembly 11 with the data presented on the depth track 121. The output signals produced from the collar locator in the housing 12 as the gun assembly 11 is lowered are shown on the trace 123, with periodic anomalies, such as at 124, clearly showing the depth locations of the casing collars as at 32. Similarly, the output signals from a gamma-radiation detector in the tool housing 13 are shown on the log trace 125, with the variations therein being used by those skilled in the art for identifying various earth formations as at 33 and 34.

Once the gun assembly 11 is known to be at the desired depth location, the switch 117 is actuated for connecting the time-based pulse generator 119 to the recorder 112 to produce a time-based log as shown at 126 in FIG. 7. Although the shot selecting and firing system 35 will also produce a similar log, the log 126 has been chosen to illustrate a typical log as will be provided during the operation of the multiple-gun shot selecting and firing system 80 so that the full scope of the present invention will be better appreciated. Accordingly, as seen in FIG. 7, the log 126 includes three separate time-based measurements or log traces 127–130 that, as will be described, are representative of the log traces which might be expected to be ordinarily produced by the multiple-gun shot selecting and firing system 80 and shot-monitoring system 36.

In keeping with the previous description of the new and improved multi-module shot selecting and firing system 80 (as well as the single-module system 35), it will be recalled that the measurement circuit 61 cooperatively functions to alternatively provide one set of output signals representative of the respective positions of the switch contact arm 50*a* (or 50*b*) and another set of output signals showing which of the gun-modules 81 or 82 is then in use. As previously discussed in detail with reference to FIG. 2, the measurement circuit 61 is cooperatively arranged so that when the positive terminal of the DC supply 65 is connected to the cable conductor 41, the Zener diodes $Z_{1a}$–$Z_{na}$ (or $Z_{1b}$–$Z_{nb}$) will respectively function to provide successive output signals such as represented by the trace 127 from which it can be determined which of several explosive devices (such as the shaped charges 21–23) are then coupled into the firing circuit for the gun assembly 11. On the other hand, as also described above with reference to FIG. 4, the measurement circuit 61 is further arranged so that when the cable conductor 41 is instead connected to the negative terminal of the DC supply 65 (such as by operation of a conventional polarity-reversing switch), the Zener 89*a* (or 89*b*) will function to provide output signals (as shown by the traces 128 and 129) indicating which of the two gun modules 81 and 82, is then being employed for selectively controlling the operation of several explosive devices such as the shaped charges 21–23.

Accordingly, it will be appreciated that when the positive terminal of the DC supply 65 is connected to the conductor 41 and the time-based pulse generator 119 is connected to the recorder 112 the trace 127 will be progressively produced as the gun assembly 11 is successively operated. Looking at FIG. 7, it will be seen that there is a first low-voltage portion 131 of the trace 127 that is representative of the measurement which will be produced only as long as the switch arm 50*a* is in its initial operating position as shown in FIG. 4. However, as shown at 132 on the log trace 127, once the switch contact arm 50*a* is advanced to its next operating position 75*a* the output signal from the measurement circuit 61 will then increase to the maximum voltage level which is representative of the total IR drop in the cable 16 as well as the cumulative Zener level of all of the several Zener diodes $Z_{1a}$–$Z_{na}$. Then, as the switch assembly 48*a* is repetitively indexed, the level of the output signals from the measurement circuit 61 will be progressively decreased in a step-by-step fashion as respectively shown at 133–143, with each of these discrete steps clearly indicating a corresponding operating position of the switch contact arm 50*a* and, therefore, showing which of the several shaped charges, as at 21–23, is then in readiness for firing.

It should be noted that the trace 127 will be momentarily interrupted from time to time as, for example, seen at 142–144. For one thing, it will be recognized that the trace 127 will be interrupted, as at 142, each time the positive terminal of the DC supply 65 is disconnected from the cable conductor 41 to allow the negative terminal of that supply to be connected to the conductor. Thus, whenever the negative terminal of the DC supply 65 is momentarily connected to the conductor 41 (as by actuating a typical reversing switch) so that the measurement circuit 61 is then measuring the Zener level of the Zener 89*a*, the recorder 112 will function to discontinue the log trace 127 and momentarily produce the log trace 128 to provide a distinctive indication that the gun module 81 is then connected to the instrumentation 17. In a similar fashion, the trace 127 will also be temporarily interrupted, such as at 143, whenever the switch 66 is opened so that the switch 40 can be actuated for firing a shaped charge, as at 21, and the switch 30 then actuated for stepping the indexing mechanism 49*a* so as to be ready for firing the next shaped charge 22. Gaps, as at 144 and 145, may also be expected to occur at spaced intervals in the trace 127 such as whenever there is an intentional delay between firing of a charge (as shown by the bar 150 and the gap 144) and stepping to the next operating position (as shown to occur by the gap 145).

At any rate, it will be appreciated that the trace 127 provides a distinctive time-based record of the successive switching steps of the switch assembly 48*a*. Those skilled in the art will recognize, of course, that the time interval between any two successive firing operations will ordinarily depend upon unrelated factors such as whether the gun assembly 11 must be moved and, if so, the time required for the gun assembly to be moved from one depth location to another. Thus, the vertical height or length of each of the several steps 132–141 is merely an indication of the elapsed time between respectively-associated switching steps. It should also be realized that the log 126 will often be produced without interruption since a depth-correlation log, as at 120, at the outset of a typical perforating operation is ordinarily sufficient. There is, however, no reason why the log 126 could not be interrupted from time to time should an additional depth-correlation log be desired during the course of a typical perforating operation.

The trace 130 is a unique time-based record of the output signals provided by the shot-monitoring system 36. As shown by the log 126, a typical trace, as at 130, is characterized by a vertical base or "zero" line having a number of vertically-disposed horizontal bars, 146–154, extending outwardly from the base line. In accordance with the preceding description of the shot-monitoring system 36, it will be recognized that these several horizontal bars 146–154 have overall lengths which are respectively representative of the magnitude of the explosive forces imposed on the gun assembly 11 as the several charges, as at 21–23, carried thereby are successively fired. Those skilled in the art will appreciate, of course, that each of the horizontal bars 146–154 are respectively associated with a given one of the steps 132–141 on the trace 127 on the log 126. Thus, simply by visual comparison of the traces 127 and 130, it can be readily appreciated that the log 126 will uniquely indicate whether the particular explosive means associated with a given switching position of the switch assembly 48*a* was in fact detonated upon closing of the switch 40 and, if the associated explosive means did detonate, whether the resulting detonation force was of sufficient magnitude to make it evident that the explosive means had properly performed.

It will be noted that in comparison to the two shorter bars 149 and 151, the other bars 146–148, 150 and 152–154 are of considerable length; and by way of experience it is quite evident that since these longer bars are each of a comparable length, the explosive means respectively associated with those longer bars had been successfully detonated. On the other hand, it is quite apparent that the explosive means respectively associated with the shorter bars were not satisfactorily detonated so that firing of a substitute explosive charge was needed.

By virtue of the traces 127–130, the log 126 provides a clear record of the performance of a given well-completion operation. For instance, in keeping with the preceding characterization of the gun assembly 11 as being a perforating gun, those skilled in the art will recognize that once the depth of the gun assembly has been accurately established (such as by way of the depth-correlation log 120) a typical cable-driven totalizing depth register, as at 155, can be calibrated in the usual fashion. Thereafter, as the gun assembly 11 is moved back and forth in the well bore 15, the depth register 155 will be sufficiently accurate to allow the gun assembly 11 to be reliably positioned. Thus, generally, there is little, if any, need to interrupt the perforating operation and obtain a second depth-correlation. Certainly, it would not at all be uncommon for a perforating operation such as represented by at least the lower half of the log 126 to be carried out with the depth register 155 serving as the sole source of depth information.

Accordingly, in the practice of the present invention, once the depth register 155 has been properly calibrated, the surface instrumentation 17 is then operated as required for operating the gun assembly 11 as well as producing the time-based performance-record log 126. At the outset of the operation, the initial portion 131 of the trace 127 indicates a "zero" reading representing that at that time none of the Zeners $Z_{1a}$–$Z_{na}$ are in the measurement circuit 61. This is, of course, a clear indication that the switch assembly 48*a* is in its initial position as depicted in FIG. 4 and that the module 81 of the gun assembly 11 is in readiness for shooting of the first shaped charge 21.

Once the gun assembly 11 has been moved to its initial depth location (as indicated by the depth register 155), the switch 66 is opened (as evidenced by the gap 156 in the trace 127) and the switch 39 is momentarily closed to step the indexing mechanism 49*a*. This stepping operation will, of course, operate to simultaneously move the ganged switch contact arms 50*a*, 51*a* and 86*a* in unison to their respective first operating positions. This initial stepping operation of the switch assembly 48*a* will, therefore, serve to connect the cable conductor 41 to the conductor 44*a* and place the full array of the Zener diodes $A_{la}$–$Z_{na}$ in series with the cable conductor and the indexing mechanism 49*a*. Thus, as shown by the log 126, when the switch 66 is again closed, the trace 127 will move from its initial "zero" position at 131 to its first voltage level or step, as at 132, thereby clearly providing a reliable indication that the first gun module 81 is then in readiness for operation and that the first shaped charge, as at 21, associated with the module can now be fired.

It will be recalled from the preceding description of FIG. 4 that stepping of the switch assembly 48*a* in the gun module 81 to the first operating position of the switch assembly will also be effective for disconnecting the shunting conductor 96*a*. Once this is done, whenever the negative terminal of the DC supply 65 is connected to the cable conductor 41, the level of the output signal from the measurement circuit 61 will be solely dependent upon the Zener level of the Zener diode 89*a*. The indicating means 87*b* will, of course, be completely out of the measuring circuit 61 until the switch assembly 48*a* reaches its final position as represented by the switch contact arm 50*a* finally reaching the contact 95*a*. Thus, so long as the first gun module 81 is being operated, the Zener diode 89*a* will remain in the measurement circuit 61 so that a confirmation trace, as at 128, will be produced on the log 126 each time the negative terminal of the DC supply 65 is connected to the cable conductor 41.

Accordingly, once the switch assembly 48*a* is in its first operating position, the new and improved measurement circuit 61 will be effective upon connection of the negative terminal of the supply 65 to the cable conductor 41 for producing one distinctive and conclusive indication (e.g., the log trace 128) showing that the first gun module 81 is in readiness and, upon reversal of these terminals, for producing another distinctive and conclusive indication (e.g., the log trace 127) showing which of the several explosive means coupled to the module is then in readiness for firing. With the assurance that the first explosive means, such as the shaped charge 21, is indeed connected into the firing circuit, the new and improved shot selecting and firing system 35 can, of course, be operated as previously described for detonating that charge. Then, by observing a suitable distinctive response on the log trace 130 (such as provided by the horizontal bar 146), it will be reliably established that the charge 21 (as indicated by the position of the trace portion 132) was detonated with a significant force (as indicated by the overall length of the horizontal bar 146). With nothing more, at the time of the initial firing of the gun assembly 11 previous experience must be relied upon to know that the overall length of the bar 146 represents satisfactory detonation of the first shaped charge 21.

As previously described, the switch 39 in the shot selecting and firing system 35 is readily operated for stepping the switch assembly 48*a* to its next operating position for connecting the second charge 22 into the firing circuit. Hereagain, with the positive terminal of the DC supply 65 connected to the cable conductor 41, closure of the switch 66 will produce the trace portion 133 on the log trace 127 thereby reliably indicating that the second charge 22 is in readiness for firing. Thus, upon operation of the switch 40, the shaped charge 22 will be detonated, with the bar 147 on the log trace 130 giving a confirming indication that the charge was properly detonated. It will, of course, be appreciated that the similar lengths of the two bars 146 and 147 serve as a further assurance that the two charges 21 and 22 were satisfactorily fired and that perforations were produced.

Operation of the switch assembly 48*a* will ordinarily continue as just described, with each of the remaining steps 134–141 in the log trace 127 respectively serving to reliably indicate which of the several shaped charges associated with the gun module 81 is then in the firing circuit. It will be noted that the differences in the vertical height of each of the several steps 132–141 is typical of different time intervals spent either in moving the gun assembly 11 to various positions or by delays in the operating sequence.

To illustrate one typical situation which may arise from time to time, it will be noted that although the first three charges 21–23 (as indicated by the successive steps 132–134 in the log trace 127) were each successfully fired (as indicated by the successive extended horizontal bars 146–148 in the log trace 130), the next operation of the shot firing switch 40 results in a relatively-short horizontal bar 149 being produced on the log trace 130 directly opposite to the step 135 on the log trace 127. By visual comparison with the three much-longer bars 146–148, it is, of course, readily apparent from the short horizontal bar 149 that for some reason the fourth charge either failed to detonate at all or else it underwent only a low-order detontion. Whatever caused this malfunction, it is necessary for another charge to be actuated so as to produce a satisfactory perforation at that depth location in the well bore 15. Thus, the new and improved shot selecting and firing system 35 is quickly operated (as shown, for example, by the relatively-short vertical height of the step 135) to index the switch assembly 48*a* for connecting the next charge into the firing circuit (as shown, for example, by the step 136). Then, upon closure of the switch 40, that shaped charge is detonated; and, as represented by the overall length of the resulting bar 150, a satisfactory perforation was then produced at that depth location in the well bore 15. As previously mentioned, although firing of a charge and stepping of the switch assembly 48*a* to its next position could well take place in a time interval no greater than represented by the gap 144 alone, the gap 145 is depicted to give an example of a delay in the switching operation.

Another common situation is represented by the two bars 151 and 152 which, by their distinctively different lengths, respectively indicate that the shaped charge connected to the sixth position of the switch assembly 48*a* was misfired and that the next shaped charge was properly detonated when the switch assembly 48*a* was in its seventh position. Again, as represented by the relatively-short vertical heights of the steps 137 and 138 and the presence of little or no gaps in these steps, it will be appreciated that in this illustrated situation a minimum time was spent in shooting the sixth and seventh charges.

As previously described, the new and improved shot-monitoring system 36 is also capable of indicating the total lack of detonation of explosive means. For instance, it will be noted that there is no horizontal bar portion on the log trace 130 opposite to the vertical step 139 on the log trace 127. The total absence of a horizontal bar will, of course, serve as a clear indication that a particular charge has failed to properly fire. Thus, as indicated by the bar 153 directly opposite to the next step 140, the next charge in the gun assembly 11 was successively fired. In a similar fashion, the bar 154 opposite the step 141 indicates that the last charge controlled by the gun module 81 was also satisfactorily fired.

It will be appreciated that although the seven horizontal bars 146–148, 150, and 152–154 are of slightly different lengths, they nevertheless clearly demonstrate that the gun assembly 11 was subjected to seven major impacts of sufficient magnitude to be assured that seven perforations were produced. It should also be noted that the outer ends of these seven horizontal bars 146–148, 150, and 152–154 collectively define an imaginary trend line, as at 157, which will serve as a valuable reference for reliably knowing whether similar charges on the gun assembly 11 are successfully detonated. It should also be noted that (at least in some instances) this imaginary trend line 157 may be inclined slightly to the right on the log 126 showing that those charges on the top of the gun assembly 11 produced slightly-greater explosive impacts than did those charges on the bottom of the gun assembly. As previously mentioned, the minor, but noticable, increase in the length of those horizontal bars 146–148, 150, and 152–154 that collectively define this imaginary inclined trend line 157 serves as a confirmation that the charges on the gun assembly are being successively fired in at least the approximate sequence as planned.

As illustrated in FIG. 7, it will be seen that once the switch assembly 48*a* has been indexed or stepped to its final switching position, the log trace 130 will again return to zero, as shown at 158, thereby showing that the contact arm 50*a* has reached its last contact 95*a*. As shown in FIG. 4 it will be appreciated that the indication 158 is produced since at this point in the operation of the gun assembly 11 the Zener diodes $Z_{la}$–$Z_{na}$ are no longer in the measurement circuit 61 and the Zener diodes $Z_{lb}$–$Z_{nb}$ have not yet been connected into the measurement circuit. This, of course, will conclude the operation of the first gun module 81 and now connect the second gun module 82 to the surface instrumentation 17.

The next actuation of the switch-stepping switch 39 will be effective for shifting the switch assembly 48*b* to its initial operating position. This initial operating position will also disconnect the shunting conductor 96*b*. Thus, as will be appreciated upon study of FIG. 4, whenever the negative terminal of the supply 65 is connected to the cable conductor 41 and the switch 66 is closed the level of the output signal provided by the measurement circuit 61 will now be dependent upon the combined Zener levels of both the Zener diodes 89*a* and 89*b*. Accordingly, as shown by the log trace 129, the new and improved measurement circuit 61 will clearly indicate that the second gun module 82 is in readiness for operation. Similarly, upon connection of the cable conductor 41 to the positive terminal of the DC supply 65 (such as by operating a typical polarity-reversing switch) and closure of the switch 66, as shown in FIG. 6 the measurement circuit 61 will now function to carry the log trace 127 to a first step as at 159. By inspection of FIG. 4, it will, of course, be seen that the step 159 is representative of the combined Zener levels of the Zener diodes $Z_{lb}$–$Z_{nb}$. Since the log 126 shows the step 159 to be at a level equal to the level of the corresponding step 132 it is known that the Zener diodes $Z_{lb}$–$Z_{nb}$ are duplicates of the Zener diodes $Z_{la}$–$Z_{na}$. It should, however, be understood that the two diode arrays $Z_a$ and $Z_b$ could just as well have been selected so that the step 159 and all succeeding steps in the log trace 127, as at 160–168, would be at levels which are respectively of sufficient differences from the steps 132–141 that it would be conclusively known that the second gun module 82 is being operated. This alternative would provide a characteristic indication either confirming the trace 129 or serving as a substitute for that trace.

In any event, it will be realized by comparison of the upper and lower portions of the log traces 127 and 130 that successive operations of the gun module 82 will be quite similar to the successive operations of the gun module 81. Hereagain, the new and improved shot-monitoring system 36 will function to provide a series of horizontal bars, as at 169–177, on the log 126 in response to firing of the gun assembly 11. Moreover, the outer ends of the several bars 169–177 will collectively define an imaginary trend line 178 which, as depicted in FIG. 7, is an extension or extrapolation of the imaginary trend line 157. Again it will be noted that the trend line 178 shows that the explosive means on the gun assembly 11 which are being fired by operation of the gun module 82 are most likely being successively fired in their intended sequence.

As a further illustration of the usefulness of the new and improved shot-monitoring system 36, it will be seen that although the log trace 130 has an elongated bar 171 horizontally opposite a gap 178 in the step 161 on log trace 127, the log trace 130 has no horizontal bar lying directly opposite the gap 179 in the log trace which is ordinarily produced upon opening of the switch 66 so as to allow closure of first the switch 40 and then the switch 39. The absence of a bar opposite the gap 179 will, as previously described, serve as sufficient notice that some malfunction has occurred in the gun assembly 11 and that another charge must be readied.

The appearance of the step 163 on the log trace 127 will, of course, demonstrate that the next explosive means on the gun assembly 11 has been readied for actuation upon closure of the switch 40. However, should the next shaped charge also be defective and, for example, only its associated detonator be fired upon closure of the switch 40, if any horizontal bar is produced its overall length will be quite short as at 172.

Accordingly, it will be recognized that the new and improved methods and apparatus of the present invention are of particular utility in controlling as well as monitoring the operation of a well tool carrying two or more selectively-fired explosive devices such as shaped-explosive charges or formation-coring bullets. In practicing the present invention, the switching assembly used for sequentially connecting these charges to a source of detonating current is also cooperatively arranged so that at one or more selected switching positions, the lower ends of the electrical conductors in the suspension cable supporting the tool will be selectively connected to one or more Zener diodes having predetermined operating characteristics. In this manner, whenever the switching assembly has been moved to one of those selected positions, by selectively coupling a source of AC and DC to the upper ends of the cable conductors, the output measurements obtained at the surface will be sufficiently independent of the IR drop in the conductors that it can be reasonably confirmed that the switching assembly is in the switching position corresponding to the predetermined opening characteristic of the Zener diode or diodes which are known to be operative at that switching position. As a further aspect of the present invention, this unique principle is also used in providing distinctive measurements from which it can be reliably ascertained that a given gun assembly is then in readiness for operation.

The invention further includes new and improved methods for sensing the detonation of each of the explosive charges on a gun assembly and providing an output signal which is representative of the magnitude of the resulting explosive force. By comparing the output signals successively obtained in response to the detonation of each charge, it can be reasonably determined when one of these charges has failed to properly perform.

While only particular embodiments of the present invention and modes of practicing the invention have been shown and described, it is apparent that changes and modifications may be made without departing from this invention in its broader aspect; and, therefore, the aim in the appended claims is to cover all such changes and modifications as fall within the true spirit and scope of this invention.

What is claimed is:

1. Apparatus adapted for controlling and monitoring the operation of a well tool carrying a plurality of electrically-detonatable explosive means respectively adapted to be separately detonated and comprising:

voltage-responsive diode means operative for conducting electrical current only in response to DC voltage of at least a predetermined potential level;

switching means movable to successive switch positions in response to selected switch-operating signals and including first switch means cooperable at different ones of said switch positions and adapted for sequentially establishing electrical communication with those electrically-detonatable explosive means carried on such a well tool that are to be separately detonated, and second switch means movable in synchronism with said first switch means and cooperable for establishing electrical communication with said diode means at a selected one of said switch positions; and surface-instrumentation means adapted for connection to said switching means by way of electrical-conductor means and including electrical-source means operative whenever said switching means are in said selected switch position for passing alternating current through such electrical-conductor means to obtain an AC measurement representative of the IR drop therein and for simultaneously passing direct current at a voltage level no less than said predetermined potential level through such electrical-conductor means and said diode means to obtain a DC measurement representative of the summation of said predetermined potential level and the IR drop in such electrical-conductor means, and output means responsive to said AC and DC measurements for providing a confirming output indication representative of said predetermined potential level whenever said switching means are in said selected switch position.

2. The apparatus of claim 1 wherein said surface-instrumentation means are operative whenever said switching means are in switch positions other than said selected switch position for providing other output indications which are respectively distinctive from said confirming output indication.

3. The apparatus of claim 1 further including:

detonation-responsive means operatively arranged for producing output signals in response to the detonations of those electrically-detonatable explosive means carried on such a well tool; and signal-detecting means operatively arranged with said surface-instrumentation means for sensing said output signals produced by said detonation-responsive means to provide one or more indications representative of said output signals for at least confirming the detonations of electrically-detonatable explosive means carried on such a well tool.

4. The apparatus of claim 1 further including:

detonation-responsive means operatively arranged for producing output signals in response to the detonation of electrically-detonatable explosive means carried on such a well tool and with said output signals respectively having a characteristic parameter representative of the magnitude of the detonation forces detected thereby; and signal-detecting means operatively arranged with said surface-instrumentation means for sensing said output signals produced by said detonation-responsive means to provide one or more output indications respectively representative of the characteristic parameter of said output signals for confirming the detonations of electrically-detonatable explosive means carried on such a well tool as well as for signifying the relative magnitude of such detonation forces.

5. The apparatus of claim 1 wherein said diode means include one Zener diode with which said second switch means will establish electrical communication at said selected switch position and another Zener diode with which said second switch means will establish electrical communication at another switch position of said switching means so that upon movement of said switching means to said successive switch positions, said output means will be operative for providing one confirming output indication representative of said predetermined potential level of said one Zener diode whenever said switching means are in said selected switch position and for providing another confirming output indication representative of said predetermined potential level of said other Zener diode whenever said switching means are in said other switch position.

6. The apparatus of claim 5 wherein said surface-instrumentation means are operative whenever said switching means are in one or more switch positions other than said selected switch position and said other switch position for providing further output indications which are respectively distinctive from said confirming output indications.

7. Well-bore apparatus adapted for operation in a well bore and comprising:

body means adapted for suspension in a well bore;

a plurality of electrically-detonatable explosive means on said body means and respectively adapted to be sequentially detonated;

a suspension cable including electrical-conductor means and having a lower end connected to said body means and an upper end extending to the surface;

switching means on said body means and adapted for movement to successive switch positions in response to selected switch-operating signals and including first switch means cooperable for sequentially establishing electrical communication with each of said electrically-detonatable explosive means, voltage-responsive diode means operative for conducting electrical current only in response to DC voltage of at least a predetermined potential level, and second switch means cooperable at least at a selected one of said switch positions for electrically connecting said diode means to said electrical-conductor means adjacent to said lower cable end; and surface-instrumentation means connected to said electrical-conductor means adjacent to said upper cable end and including electrical-source means operatively arranged whenever said switching means are at said selected switch position for passing a constant alternating current through said electrical-conductor means to produce an AC measurement signal representative of the overall IR drop in said electrical-conductor means and for simultaneously passing a constant direct current at no less than said predetermined potential level through said electrical-conductor means and said diode means to produce a DC measurement signal representative of the summation of the IR drop in said electrical-conductor means and said predetermined potential level, and means operable in response to said AC and DC measurement signals for providing a confirming output indication representative of said predetermined potential level whenever said switching means are in said selected switch position.

8. The apparatus of claim 7 wherein said surface-instrumentation means are operative whenever said switching means are at switch positions other than said selected switch position for providing other output indications which are respectively distinctive from said confirming output indication.

9. The apparatus of claim 7 wherein said diode means include one Zener diode with which said second switch means will establish electrical communication at said selected switch position and another Zener diode with which said second switch means will establish electrical communication at another switch position of said switching means so that upon movement of said switching means to said successive switch positions, said output means will be operative for providing one confirming output indication representative of said predetermined potential level of said one Zener diode whenever said switching means are in said selected switch position and for providing another confirming output indication representive of said predetermined potential level of said other Zener diode whenever said switching means are in said other switch position.

10. The apparatus of claim 9 wherein said surface-instrumentation means are operative whenever said switching means are in one or more switch positions other than said selected switch position and said other switch position for providing further output indications which are respectively distinctive from said confirming output indications.

11. The apparatus of claim 7 further including:

detonation-responsive means electrically connected to said one end of said electrical-conductor means and operatively arranged on said tool body for producing electrical output signals in response to the detonations of said electrically-detonatable explosive means; and signals-detecting means operatively arranged with said surface-instrumentation means electrically connected to said other end of said electrical-conductor means and adapted for receiving output signals produced by said detonation-responsive means to provide output indications representative of said electrical output signals for confirming the detonations of said electrically-detonatable explosive means.

12. The apparatus of claim 11 wherein said electrically-detonatable explosive means include at least two shaped-explosive charges and at least two electrically-responsive explosive detonators operatively connected to said first switch means and respectively arranged for individually detonating said shaped-explosive charges in response to electrical current.

13. The apparatus of claim 7 further including:

detonation-responsive means on said tool body electrically connected to said one end of said electrical-conductor means and operative in response to detonations of said electrically-detonatable explosive means for producing electrical output signals respectively having a characteristic parameter representative of the magnitude of the resulting detonation forces; and signal-detecting means operatively arranged with said surface-instrumentation means connected to said other end of said electrical-conductor means and adapted for receiving output signals produced by said detonation-responsive means to provide output indications respectively representative of the characteristic parameter of each of said electrical output signals for confirming the detonations of said electrically-detonatable explosive means as well as for signifying the relative magnitude of such detonation forces.

14. The apparatus of claim 13 wherein said electrically-detonatable explosive means include at least two shaped-explosive charges and at least two electrically-responsive explosive detonators operatively connected to said first switch means and respectively arranged for individually detonating said shaped-explosive charges in response to electrical current.

15. Apparatus adapted for controlling and monitoring the operation of a plurality of electrically-detonatable explosive devices suspended in a well bore by an electrical cable and respectively adapted to be sequentially detonated and comprising:

body means adapted for connection to an electrical cable;

switching means on said body means selectively movable to individual operating positions in response to successive switch-actuating signals and including first switch means adapted for sequentially establishing electrical communication at different ones of said operating positions with electrically-detonatable explosive devices coupled to said body means, and second switch means having a plurality of individual switch contacts at selected ones of said operating positions which are respectively adapted to be electrically connected to an electrical cable supporting said body means;

means adapted for establishing a plurality of distinctive DC voltage levels respectively characteristic of each of said selected operating positions of said switching means and including a plurality of voltage-responsive Zener diodes respectively chosen to conduct only in response to DC voltage greater than a predetermined minimum voltage level and which collectively are selectively oriented with respect to polarity and operatively interconnected to one another in a serial array with tap connections therebetween respectively connected to said individual switch contacts for collectively defining said distinctive voltage levels; and surface-instrumentation means including constant-current electrical-source means adapted for selective connection to the surface end of an electrical cable supporting said body means and cooperatively arranged for simultaneously applying thereto a selected AC voltage and a selected DC voltage for obtaining one measurement signal representative of the AC IR drop in an electrical cable supporting said body means and for obtaining another measurement signal representative of the arithmetical summation of the DC IR drop in an electrical cable supporting said body means and of that one of said distinctive DC voltage levels respectively corresponding to the present selected operating position of said switching means, means operatively arranged for correlating said measurement signals to provide at least one output signal as said switching means are moved to each of said operating positions which is representative of that one of said distinctive DC voltage levels, and indicating means operable in response to said output signal and adapted for providing an indication at each of said operating positions which is representative of the present operating position of said switching means.

16. The apparatus of claim 15 further including:

detonation-responsive means adapted for mounting on said body means and operatively arranged for producing characteristic signals in response to the detonations of electrically-detonatable explosive devices carried thereby; and signal-detecting means operatively arranged with said surface-instrumentation means and adapted for sensing characteristic signals produced by said detonation-responsive means to provide output indications representative of said characteristic signals for confirming the detonations of electrically-detonatable explosive devices carried by said tool body.

17. The apparatus of claim 15 further including:

detonation-responsive means adapted for mounting on said body means and operatively arranged for producing electrical output signals in response to the detonation of electrically-detonatable explosive devices carried thereby and respectively having a characteristic parameter representative of the magnitude of such detonation forces; and signal-detecting means operatively arranged with said surface-instrumentation means and adapted for receiveing said electrical output signals from said detonation-responsive means to provide output indications respectively representative of the characteristic parameter of each of said electrical output signals for confirming the detonations of electrically-detonatable explosive devices carried by said tool body as well as for signifying the relative magnitudes of such detonation forces.

18. Well-bore apparatus comprising:

body means adapted for movement through in a well bore;

a suspension cable coupled to said body means and including electrical-conductor means adapted to extend between said body means and the surface;

a plurality of electrically-detonatable explosive devices mounted at spaced intervals on said body means, with at least a first one of said explosive devices being adapted for detonation independently of at least a second one of said explosive devices;

switching means on said body means including a plurality of ganged multi-contact switches adapted to be successively advanced in unison to corresponding switch positions in response to selected switch-advancing signals, one of said ganged switches being cooperable at a selected first switch position for establishing independent electrical communication with said first explosive device and cooperable at a selected second switch position for establishing independent electrical communication with said second explosive device, and another one of said ganged switches having individual first and second contacts respectively cooperable at said first and second switch positions for establishing independent electrical communication with said electrical-conductor means adjacent to the sub-surface end of said suspension cable;

first and second voltage-responsive Zener diodes respectively connected to said first and second contacts, with each of said Zener diodes adapted to conduct in response to DC voltage of a given polarity at a predetermined DC voltage potential and operatively defining distinctive first and second operating voltage levels; and surface-instrumentation means adapted for selective connection to said electrical-conductor means adjacent to the sub-surface end of said suspension cable including constant-current electrical-source means cooperatively arranged for applying AC voltage to said electrical-conductor means to produce one output signal representative of the AC IR drop therein and for simultaneously applying DC voltage of said given polarity in excess of said predetermined DC voltage potential to said electrical-conductor means to produce another output signal representative of the summation of the DC IR drop therein and of said operating voltage level respectively, and signal-combining means cooperatively arranged and adapted for combining said output signals and providing characteristic first and second signals at the surface respectively representing which of said first and second switch positions said switching means are then in.

19. The well-bore apparatus of claim 18 further including:

detonation-responsive means on said body means connected to said electrical-conductor means adjacent to said sub-surface end of said suspension cable and operatively arranged for producing output signals in response to the detonation of said explosive devices; and signal-detecting means connected to said electrical-conductor mean adjacent to said sub-surface end of said suspension cable and operatively arranged with said instrumentation means and adapted for sensing output signals from said detonation-responsive means to provide output indications representative of said output signals for confirming the detonation of each of said explosive devices.

20. The well-bore apparatus of claim 18 further including: detonation-responsive means on said body means connected to said electrical-conductor means adjacent to said sub-surface end of said suspension cable and operatively arranged for producing output signals in response to the detonation of said explosive devices with said output signals respectively having at least one characteristic parameter representative of the magnitude of the resulting detonation forces produced by detonation of said explosive devices; and signal-detecting means connected to said electrical-conductor means adjacent to said surface end of said suspension cable and operatively arranged with said instrumentation means for sensing output signals from said detonation-responsive means to respectively provide output indications representative of the characteristic parameter of said output signals for confirming the detonation of each of said explosive devices as well as for signifying the general character of such detonation forces.

21. The well-bore apparatus of claim 18 wherein said one ganged switch is cooperatively arranged for independently connecting said explosive devices to said electrical-conductor means adjacent to said sub-surface end of said suspension cable and further including:

electrical-source means adapted for selective connection to said electrical-conductor means adjacent to said surface end of said suspension cable and cooperatively arranged to detonate said explosive devices when they are respectively connected to said electrical-conductor means by said one ganged switch.

22. The well-bore apparatus of claim 21 wherein said first explosive device includes a first shaped-explosive charge and a first electrically-responsive explosive detonator operatively arranged for detonating said first shaped-explosive charge only when said one ganged switch is in its said first switch position and said electrical-source means are connected to said electrical-conductor means; and said second explosive device includes a second shaped-explosive charge and a second electrically-responsive explosive detonator operatively arranged for detonating said second shaped-explosive charge only when said one ganged switch is in its said second switch position and said electrical-source means are connected to said electrical-conductor means.

23. The well-bore apparatus of claim 21 wherein said first explosive device includes a first coring bullet and a first electrically-responsive explosive charge operatively arranged, upon its detonation, for propelling said first coring bullet away from said body means only when said one ganged switch is in its said first switch position and said electrical-source means are connected to said electrical-conductor means; and said second explosive device includes a second coring bullet and a second electrically-responsive explosive charge operatively arranged, upon its detonation, for propelling said second coring bullet away from said body means only when said one ganged switch is in its said second switch position and said electrical-source means are connected to said electrical-conductor means.

24. Well-bore perforating apparatus comprising:

body means including a plurality of enclosed charge housings tandemly coupled together;

a suspension cable coupled to said body means and including means defining two electrical conductors;

perforating means including an electrically-responsive detonator and at least one shaped-explosive charge cooperatively arranged in each of said charge housings;

switching means on said body means including a plurality of multi-contact switches adapted to be successively advanced to different operating positions in response to selected switch-advancing signals, one of said switches being cooperable at two or more of its said operating positions respectively for independently connecting each of said explosive detonators to said electrical conductors in a predetermined sequence, and another one of said switches having a plurality of contacts respectively cooperable at preselected ones of said operating positions for establishing electrical communication with said electrical conductors;

voltage-responsive diode means including a plurality of Zener diodes operatively connected to said contacts of said other switch and respectively adapted for conducting in response to DC voltage of a selected polarity and potential for defining distinctive voltage levels respectively representative of each of said preselected operating positions; and surface-instrumentation means adapted for selective connection to said electrical conductors including constant-current electrical-source means adapted for simultaneously applying AC and DC voltages to said electrical conductors and cooperative whenever said switching means are advanced to each of said preselected switch switch positions for producing one output signal representative of the AC IR drop in said electrical-conductors and for producing another output signal representative of the summation of the DC IR drop in said electrical conductors and said distinctive voltage level corresponding to that one of said preselected operating positions, and signal-combining means cooperatively arranged and adapted for combining said output signals for producing an output signal which is sufficiently independent of said IR drop in said electrical conductors to be representative of said corresponding distinctive voltage level and thereby designate which of said preselected operating positions said switching means are then in.

25. The perforating apparatus of claim 24 further including:

detonation-responsive means on said body means connected to said electrical conductors and operatively arranged for producing electrical ouput signals in response to the detonators of said shaped-explosive charges; and signal-detecting means operatively arranged with said surface-instrumentation means electrically connected to said electrical conductors and adapted for receiving output signals produced by said detonation-responsive means to provide output indications respresentative of said electrical output signals for confirming the detonations of said shaped-explosive charges.

26. The perforating apparatus of claim 24 further including:

detonation-responsive means on said body means connected to said electrical conductors and operative in response to detonations of said shaped-explosive charges for producing electrical output signals respectively having a duration representative of the magnitude of the resulting detonation forces; and signal-detecting means operatively arranged with said surface-instrumentation means connected to said electrical conductors and adapted for receiving output signals produced by said detonation-responsive means to provide output indications respectively representative of the duration of each of said electrical output signals for confirming the detonations of said shaped-explosive charges as well as for signifying the relative magnitude of such resulting detonation forces.

27. The perforating apparatus of claim 24 wherein said one switch is cooperatively arranged at each of said selected operating positions for connecting said electrical conductors to a selected one of said explosive detonators.

28. The perforating apparatus of claim 28 wherein said surface-instrumentation means include electrical-source means adapted for connection to said electrical conductors for selectively detonating said explosive detonators as required for firing said shaped-explosive charges.

29. The perforating apparatus of claim 24 wherein said switching means include an electrically-responsive switch actuator connected to said electrical conductors and including means co-operatively coupled to said switches for successively advancing said switches to said operating positions in response to said switch-advancing signals; and said surface-instrumentation means include an electrical source adapted for connection to said electrical conductors for selectively supplying said switch-advancing signals to said switch actuator as required for controlling said switching means.

30. The perforating apparatus of claim 29 wherein said surface-instrumentation means include electrical-source means adapted for connection to said electrical conductors for selectively detonating said explosive detonators as required for firing said shaped-explosive charges.

31. The perforating apparatus of claim 24 wherein said Zener diodes collectively are oriented with respect to a given polarity and operatively interconnected to one another in a serial array with tap connections therebetween respectively connected to said contacts with said distinctive voltage levels of said Zener diodes collectively defining a series of progressive steps.

32. The perforating apparatus of claim 31 wherein said one switch is cooperatively arranged for successively disabling each of said Zener diodes upon successive advancement of said switching means so that said progressive steps will be at successively-lower voltage levels upon successive advancement of said switching means.

33. The perforating apparatus of claim 31 wherein said one switch is cooperatively arranged for successively enabling each of said Zener diodes upon successive advancement of said switching means so that said progressive steps will be at successively-higher voltage levels upon successive advancement of said switching means.

34. Well-bore perforating apparatus comprising:

body means including a plurality of enclosed charge housings tandemly coupled together to provide upper and lower assemblies of said charge housings;

a suspension cable coupled to said body means and including means defining two electrical conductors;

perforating means including an electrically-responsive explosive detonator and at least one shaped-explosive charge cooperatively arranged in each of said charge housings;

switching means on said body means including first and second multi-contact switch assemblies respectively adapted for selective advancement to different operating positions and each having a contact cooperable at a selected operating position for respectively establishing electrical communication with said electrical conductors, one of said switch assemblies being cooperable at two or more of its said operating positions for sequentially connecting said electrical conductors to each of said detonators in said upper assembly of charge housings and the other of said switch assemblies being cooperable at two or more of its said operating positions for sequentially connecting said electrical conductors to each of said detonators in said lower assembly of charge housings;

voltage-responsive diode means including first and second Zener diodes respectively connected to said selected contacts of said first and second switch assemblies, each of said Zener diodes being respectively adapted to conduct in response to DC voltage of a selected polarity and potential defining a distinctive operating voltage; and surface-instrumentation means adapted for selective connection to said electrical conductors including constant-current electrical-source means adapted for simultaneously applying AC and DC voltages to said electrical conductors and cooperative upon advancement of said first switch assembly to its said selected operating position for producing a first set of output signals respectively representative of the AC IR drop in said electrical conductors and of the summation of the DC IR drop in said electrical conductors and of the summation of the DC IR drop in said electrical conductors and said distinctive operating voltage of said first Zener diode and cooperative whenever said second switch assembly is advanced to its said selected operating position for producing a second set of output signals respectively representative of the AC IR drop in said electrical conductors and of the summation of the DC IR drop in said electrical conductors and said distinctive operating voltage of said second Zener diode, and signal-correlating means cooperatively arranged and adapted for correlating each set of said output signals to provide a first characteristic indication which is sufficiently independent of said IR drop in said electrical conductors to be representative of said distinctive operating voltage of said first Zener diode and thereby designate whenever said first switch assembly is in its selected operating position as well as for providing a second characteristic indication which is sufficiently independent of said IR drop in said electrical conductors to be representative of said distinctive operating voltage of said second Zener diode and thereby designate whenever said second switch assembly is in its said selected operating position.

35. The perforating apparatus of claim 34 wherein said selected operating position of said first switch assembly is one of its said operating positions where one of said detonators is connected to said electrical conductors so that said first characteristic indication indicates that the corresponding shaped-explosive charge associated with that detonator is then in readiness for detonation.

36. The perforating apparatus of claim 34 wherein said selected operating position of said second switch assembly is at one of its said operating positions where one of said detonators is connected to said electrical conductors so that said second characteristic indication indicates that the corresponding shaped-explosive charge associated with that detonator is then in readiness for detonation.

37. The perforating apparatus of claim 34 wherein said first and second Zener diodes are respectively adapted to conduct in response to DC voltage of the same polarity.

38. The well-bore apparatus of claim 34 further including:

detonation-responsive means on said body means connected to said electrical conductors adjacent to the sub-surface end of said suspension cable and operatively arranged for producing output signals in response to the detonation of said explosive devices with said output signals respectively having a characteristic parameter representative of the magnitude of the resulting detonation forces produced by detonation of said explosive devices; and signal-detecting means connected to said electrical conductors adjacent to the surface end of said suspension cable and operatively arranged with said surface-instrumentation means for sensing output signals from said detonation-responsive means to respectively provide output indications representative of said characteristic parameter of said output signals for confirming the detonation of each of said explosive devices as well as for signifying the general character of such detonation forces.

39. The perforating apparatus of claim 34 wherein each of said first and second switch assemblies includes one or more additional contacts cooperable at different operating positions for respectively establishing electrical communication with said electrical conductors; and said voltage-responsive doide means include a first set of additional Zener diodes operatively connected to said additional contacts of said first switch assembly and respectively adapted for conducting in response to DC voltage of a selected polarity and potential defining a distinctive operating voltage as well as a second set of additional Zener diodes operatively connected to said additional contacts of said second switch assembly and respectively adapted for conducting in response to DC voltage of a selected polarity and potential defining a distinctive operating voltage so that said surface-instrumentation means will provide additional first and second characteristic indications which are respectively representative of the distinctive operating voltages of said additional Zener diodes to thereby indicate when corresponding shaped-explosive charges in said upper and lower housings are respectively in readiness for detonation.

40. The perforating apparatus of claim 39 wherein each set of said first and second additional Zener diodes is oriented collectively with respect to a selected polarity and operatively interconnected in a series array with tap connections therebetween respectively connected to said additional contacts of said first and second switch assemblies with said distinctive operating voltages of said additional Zener diodes collectively defining a series of progressive steps.

41. The perforating apparatus of claim 40 wherein each of said first and second switch assemblies is cooperatively arranged for successively disabling each of said additional Zener diodes from its respective array so that said progressive steps will be at successively-lower voltage levels upon successive advancement of its associated switch assembly.

42. The perforating apparatus of claim 40 wherein each of said first and second switch assemblies is cooperatively arranged for successively enabling each of said additional Zener diodes from its respective array so that said progressive steps will be at successively-higher voltage levels upon successive advancement of its associated switch assembly.

43. The perforating apparatus of claim 34 wherein said switching means include means cooperatively arranged for delaying operating of said second switch assembly until said first switch assembly has been advanced to a selected final operating position.

44. The perforating apparatus of claim 43 further including:

first indicating means cooperative before said first switch assembly has been advanced to its said final operating position and cooperatively associated with said surface-instrumentation means for producing a first confirming indication whenever said first switch assembly is then in readiness for successive advancement; and second indicating means cooperative only when said first switch assembly has been advanced to its said final operating position and cooperatively associated with said surface-instrumentation means for producing a second confirming indication whenever said second switch assembly is then in readiness for successive advancement.

45. The perforating apparatus of claim 43 further including:

indicating means operative before said first switch assembly has been advanced to its said final operating position and cooperatively associated with said surface-instrumentation means for providing a confirming indication whenever said first switch assembly is in readiness for successive advancement.

46. The perforating apparatus of claim 45 wherein said indicating means include a selected Zener diode cooperatively connected between said electrical conductors and said first switch assembly and adapted for conducting in response to DC voltage of a selected polarity and potential defining a distinctive operating voltage so that, upon operation, said surface-instrumentation means will produce a set of indicating output signals respectively representative of the AC IR drop in said electrical conductors and of the summation of the DC IR drop in said electrical conductors and said distinctive operating voltage of said selected Zener diode from which said signal-correlating means will provide said confirming indication which is sufficiently independent of said IR drop in said electrical conductors to be representative of said distinctive operating voltage of said selected Zener diode to thereby designate whenever said first switch assembly is in readiness for successive advancement.

47. The perforating apparatus of claim 46 wherein said first Zener diode and said selected Zener diode are oppositely oriented with respect to one another so as to respectively conduct only in response to a DC voltage of one polarity and to a DC voltage of the opposite polarity and further including:

means cooperatively arranged with said surface-instrumentation means for selectively reversing the polarity of DC voltages respectively applied to said electrical conductors.

48. The perforating apparatus of claim 43 further including:

indicating means operative only when said first switch assembly has been advanced to its said final operating position and cooperatively associated with said surface-instrumentation means for providing a confirming indication whenever said second switch assembly is in readiness for successive advancement.

49. The perforating apparatus of claim 48 wherein said indicating means include a selected Zener diode cooperatively connected between said first switch assembly and said second switch assembly and adapted for conducting in response to DC voltage of a selected polarity and potential defining a distinctive operating voltage so that, upon operation, said surface-instrumentation means will produce a set of indicating output signals respectively representative of the AC IR drop in said electrical conductors and of the summation of the DC IR drop in said electrical conductors and said distinctive operating voltage of said selected Zener diode from which said signal-correlating means will provide said confirming indication which is sufficiently independent of said IR drop in said electrical conductors to be representative of said distinctive operating voltage of said selected Zener diode to thereby designate whenever said second switch assembly is in readiness for successive advancement.

50. The perforating apparatus of claim 49 wherein said second Zener diode and said selected Zener diode are oppositely oriented with respect to one another so as to respectively conduct only in response to a DC voltage of one polarity and to a DC voltage of the opposite polarity and further including:

means cooperatively arranged with said surface-instrumentation means for selectively reversing the polarity of DC voltages respectively applied to said electrical conductors.

51. Apparatus adapted for operation with a well tool carrying at least one explosive device and comprising:

body means adapted to be cooperatively associated with a well tool carrying one or more explosive devices adapted to be detonated;

shot-monitoring means including a transducer cooperatively arranged on said body means for producing at least one output signal having a characteristic parameter functionally related to the magnitude of an explosive force imposed thereon in response to the detonation of such explosive devices; and oscillator means responsive to said transducer output signal and adapted for producing an oscillator output signal having a characteristic parameter which is in turn representative of said characteristic parameter of said transducer output signal, and means responsive to said oscillator output signal and operatively arranged for producing output indications representative of said characteristic parameter of said transducer output signal.

52. The apparatus of claim 51 wherein said characteristic parameter of said transducer output signal is the amplitude thereof.

53. The apparatus of claim 51 wherein said characteristic parameter of said oscillator output signal is the time duration thereof.

54. The apparatus of claim 53 wherein said characteristic parameter of said transducer output signal is the amplitude thereof.

55. Apparatus adapted for controlling and monitoring the operation of a plurality of electrically-detonatable explosive devices respectively adapted to be separately detonated in a well bore and comprising:

body means adapted for suspension in a well bore;

voltage-responsive diode means operative for conducting electrical current in response to DC voltage at one or more predetermined potential levels;

switching means on said body means movable to successive switch positions in response to selected switch-operating signals and adapted for sequentially establishing electrical communication with electrically-detonatable explosive devices supported by said body means and with said diode means at one or more selected ones of said switch positions;

shot-monitoring means including a transducer cooperatively arranged on said body means for producing at least one output signal having a characteristic parameter functionally related to the magnitude of an explosive force imposed thereon in response to the detonation of such explosive devices; and means adapted for connection to said switching means and said shot-monitoring means by way of electrical-conductor means and including electrical-source means operative whenever said switching means are in one of said selected switch positions for passing alternating current through such electrical-conductor means to obtain an AC measurement representative of the IR drop therein and for simultaneously passing direct current at a voltage level no less than said predetermined potential level through such electrical-conductor means and said diode means to obtain a DC measurement representative of the summation of the corresponding one of said predetermined potential levels and the IR drop in such electrical-conductor means, first means responsive to said AC and DC measurements for providing a first confirming output indication representative of the corresponding one of said predetermined potential levels whenever said switching means are in one of said selected switch positions, and second means responsive to said transducer output signal for providing a second confirming output indication representative of said characteristic parameter of said transducer output signal.

56. The apparatus of claim 55 wherein said voltage-responsive diode means include a plurality of Zener diodes respectively connected to individual contacts of said switching means corresponding to each of said selected switch positions for distinctively defining said corresponding predetermined potential levels at each of said selected switch positions.

57. The apparatus of claim 55 wherein said characteristic parameter of said transducer output signal is the amplitude thereof.

58. The apparatus of claim 55 wherein said second means include oscillator means responsive to said transducer output signal for producing an oscillator output signal having a characteristic parameter which is in turn representative of said characteristic parameter of said transducer output signal, and means responsive to said oscillator output signal and operatively arranged for producing output indications representative of said characteristic parameter of said transducer output signal.

59. The apparatus of claim 58 wherein said voltage-responsive diode means include a plurality of Zener diodes respectively connected to individual contacts of said switching means corresponding to each of said selected switch positions for distinctively defining said corresponding predetermined potential levels at each of said selected switch positions.

60. The apparatus of claim 59 further including:

recording means adapted for connection to said first and second means and cooperatively arranged for producing first and second records of said first and second output indications on a recording medium.

61. Well-bore apparatus adapted for operation in a well bore and comprising:

body means adapted for suspension in a well bore;

a plurality of electrically-detonatable explosive devices on said body means and respectively adapted to be sequentially detonated;

a suspension cable having a lower end connected to said body means and an upper end extending to the surface and including means defining electrical conductors extending between said body means and the surface;

control means on said body means including voltage-responsive diode means operative for conducting electrical current only in response to DC voltage of one or more predetermined potential levels, and switching means operable in response to selected switch-operating signals for selectively connecting said electrically-detonatable explosive devices and said diode means to said electrical conductors at one or more selected switch positions;

shot-monitoring means including a transducer cooperatively arranged on said body means and adapted for producing an output signal having a characteristic parameter representative of the magnitude of explosive forces imposed on said body means upon detonation of one of said explosive devices; and surface-instrumentation means connected to said electrical conductors and including electrical-source means operatively arranged whenever said switching means are successively moved to each of said selected switch positions for passing a constant alternating current through said electrical conductors to produce an AC measurement signal representative of the overall IR drop in said electrical conductors and for simultaneously passing a constant direct current at no less than said predetermined potential level through said electrical conductors and said diode means to produce a DC measurement signal representative of the summation of the IR drop in said electrical conductors and that one of said predetermined potential levels corresponding to that one of said selected switch positions, means operable in response to said AC and DC measurement signals for providing a first confirming output indication representative of that one of said predetermined potential levels to show that said switching means are in that one of said selected switch positions, and means operable in response to said transducer output signal for providing a second confirming output indication representative of said characteristic parameter of said transducer output signal to signify the relative magnitude of the explosive forces imposed on said body means upon detonation of that one of said explosive devices connected to said electrical conductors in that one of said selected switch positions.

62. The well-bore apparatus of claim 61 wherein said surface-instrumentation means further include:

recording means adapted for providing a record of said first and second output indications on a recording medium.

63. The well-bore apparatus of claim 61 wherein said explosive devices include a first shaped-explosive charge and a first electrically-responsive explosive detonator operatively arranged for detonating said first shaped-explosive charge only when said switching means are in a first one of said selected switch positions and said electrical-source means are connected to said electrical conductors, and a second shaped-explosive charge and a second electrically-responsive explosive detonator operatively arranged for detonating said second shaped-explosive charge only when said switching means are in a second one of said selected switch positions and said electrical-source means are connected to said electrical conductors.

64. The well-bore apparatus of claim 63 wherein said explosive devices include a first coring bullet and a first electrically-responsive explosive charge operatively arranged, upon its detonation, for propelling said first coring bullet away from said body means only when said switching means are in a first one of said selected switch positions and said electrical-source means are connected to said electrical conductors, and a second coring bullet and a second electrically-responsive explosive charge operatively arranged, upon its detonation, for propelling said second coring bullet away from said body means only when said switching means are in a second one of its said switch positions and said electrical-source means are connected to said electrical conductors.

65. A method for monitoring the operation of an electrically-detonatable explosive device which is supported by a suspension cable having means defining at least two electrical conductors and respectively arranged for selective connection to a source of detonating current by movement of switching means to a selected operating position and comprising the steps of:

operating said switching means for supposedly moving said switching means to said selected operating position and connecting sub-surface portions of said electrical conductors to the input and output terminals of voltage-responsive diode means arranged to conduct electrical current only in response to DC voltage of at least a predetermined potential level;

connecting surface portions of said electrical conductors to a DC constant-current electrical source and to an AC constant-current electrical source for obtaining a DC measurement representative of the summation of the IR drop in said electrical conductors and said predetermined potential level and for simultaneously obtaining an AC measurement representative of the IR drop in said electrical conductors; and correlating said AC and DC measurements for obtaining an output indication which is at least sufficiently independent of said IR drop to be representative of said predetermined potential level and thereby confirm that said switching means are in said selected operating position.

66. The method of claim 65 wherein said explosive device is an electrically-responsive detonator operatively arranged for detonating a shaped-explosive charge.

67. The method of claim 65 wherein said explosive device is an electrically-responsive explosive charge operatively arranged for propelling a formation-coring bullet.

68. The method of claim 65 wherein said switching means are operative at said selected operating position for selectively connecting said explosive devices to sub-surface portions of said electrical conductors and including the additional step of:

connecting a source of detonating current to surface portions of said electrical conductors for detonating said explosive device.

69. The method of claim 68 wherein said additional step is not carried out until after said output indication has been obtained.

70. The method of claim 65 wherein said switching means are operative at said selected operating position for selectively connecting said explosive device to sub-surface portions of said electrical conductors and including the additional steps of:

connecting sub-surface portions of said electrical conductors to detonation-responsive means adjacent to said explosive device and adapted to produce an electrical signal upon detonation of said explosive device;

connecting surface portions of said electrical conductors to signal-detecting means operatively arranged to provide a characteristic output signal in response to an electrical signal produced upon detonation of said explosive device;

connecting a source of detonating current to surface portions of said electrical conductors for detonating said explosive device; and thereafter monitoring said characteristic output signal from said signal-detecting means for verifying the detonation of said explosive device.

71. The method of claim 70 wherein said additional steps are not carried out until after said output indication has been obtained.

72. A method for monitoring the sequential operation of two or more electrically-detonatable explosive devices which are supported by a suspension cable having means defining at least two electrical conductors and respectively arranged for selective connection to a source of detonating current by successive advancement of multi-position switching means to different operating positions thereof respectively corresponding to different ones of said explosive devices and comprising the steps of:

advancing said switching means to each of said selected operating positions for successively connecting sub-surface portions of said electrical conductors to the input and output terminals of a selected different ones of two or more voltage-responsive diode means respectively arranged to conduct electrical current only in response to DC voltage of a predetermined potential level;

at different ones of said selected operating positions, connecting surface portions of said electrical conductors to a DC constant-current electrical source and to an AC constant-current electrical source for obtaining a DC measurement representative of the summation of the IR drop in said electrical conductors and said predetermined potential level of said selected diode means corresponding to that selected operating position and for simultaneously obtaining an AC measurement representative of the IR drop in said electrical conductors; and correlating said AC and DC measurements for obtaining an output indication which is at least sufficiently independent of said IR drop to be representative of said predetermined potential level and thereby confirm that said switching means are then in said one selected operating position corresponding to said selected diode means.

73. The method of claim 72 wherein said diode means include a plurality of Zener diodes respectively connected to different contacts of said switching means selected to correspond to different ones of said explosive devices.

74. The method of claim 72 wherein said diode means include a plurality of Zener diodes respectively chosen to conduct only in response to DC voltage greater than a predetermined minimum voltage level and which collectively are selectively oriented with respect to polarity and operatively interconnected to one another in a serial array with tap connections therebetween respectively connected to different contacts of said switching means for collectively defining said predetermined potential levels of said Zener diodes.

75. The method of claim 72 wherein each of said explosive devices includes an electrically-responsive detonator operatively arranged for detonating a shaped-explosive charge.

76. The method of claim 72 wherein each of said explosive devices includes an electrically-responsive explosive charge operatively arranged for propelling a formation-coring bullet.

77. The method of claim 72 including the additional step of: recording said output indication at one or more of said different operating positions for providing a permanent surface record representative of the successive advancement of said switching means to said different operating positions.

78. The method of claim 72 wherein said switching means are operative at various ones of said operating positions for selectively connecting said explosive devices to sub-surface portions of said electrical conductors and including the additional steps of:

at each of said various operating positions, connecting a source of detonating current to surface portions of said electrical conductors for detonating whichever one of said explosive devices that is then connected to said electrical conductors.

79. The method of claim 78 wherein each of said additional steps are respectively carried out only after each of said output indications have been obtained.

80. A method for monitoring the operation of selectively-detonatable explosive devices dependently supported in a well bore by a suspension cable and comprising the steps of:

detonating one of said explosive devices and contemporaneously generating an amplitude signal representative of the magnitude of the explosive forces produced by said one explosive device; and generating in response to said amplitude signal a measurement signal below the surface for transmission to the surface having a time duration functionally related to said amplitude signal to provide at least one indication representative at the surface of at least the relative magnitude of said explosive forces.

81. The method of claim 80 including the additional step of: recording said measurement signal for providing a permanent surface record of said second characteristic parameter.

* * * * *